US011058910B2

(12) United States Patent
Namiki

(10) Patent No.: US 11,058,910 B2
(45) Date of Patent: Jul. 13, 2021

(54) LIMB TRAINING MACHINE

(71) Applicant: Toshiki Namiki, Nagano (JP)

(72) Inventor: Toshiki Namiki, Nagano (JP)

( * ) Notice: Subject to any disclaimer, the term of this patent is extended or adjusted under 35 U.S.C. 154(b) by 65 days.

(21) Appl. No.: 16/074,872

(22) PCT Filed: Feb. 1, 2017

(86) PCT No.: PCT/JP2017/003532
§ 371 (c)(1),
(2) Date: Aug. 2, 2018

(87) PCT Pub. No.: WO2017/135275
PCT Pub. Date: Aug. 10, 2017

(65) Prior Publication Data

US 2019/0038926 A1 Feb. 7, 2019

(30) Foreign Application Priority Data

Feb. 3, 2016 (JP) ..... JP2016-018590

(51) Int. Cl.
*A63B 21/065* (2006.01)
*A63B 21/00* (2006.01)

(52) U.S. Cl.
CPC ..... *A63B 21/065* (2013.01); *A63B 21/4011* (2015.10); *A63B 21/4017* (2015.10)

(58) Field of Classification Search
CPC ..... A63B 21/065; A63B 21/4011; A63B 21/4013; A63B 21/4017; A63B 21/4019; A63B 21/4021
See application file for complete search history.

(56) References Cited

U.S. PATENT DOCUMENTS 1,729,209 A 9/1929 Curtice
3,490,766 A * 1/1970 Gardner ..... A63B 21/065 482/105
4,330,120 A * 5/1982 Netti ..... A63B 21/065 2/160
4,556,215 A * 12/1985 Tarbox ..... A63B 21/065 2/161.1

(Continued)

FOREIGN PATENT DOCUMENTS

EP 1 832 184 A1 9/2007
JP S62-090672 U 6/1987

(Continued)

OTHER PUBLICATIONS

International Search Report issued in PCT/JP2017/003532; dated Mar. 7, 2017.

*Primary Examiner* — Joshua Lee
(74) *Attorney, Agent, or Firm* — Studebaker & Brackett PC

(57) ABSTRACT

This limb training machine 1 is provided with a wearable main body unit 2 that can be worn on a limb B, and with a first weight 31 and a second weight 32 mounted on the wearable main body unit 2 and, in a state worn on the limb B, applying a load to the limb by means of the weight of the first weight 31 and the second weight 32, wherein, in said worn state, the first weight 31 and the second weight 32 are substantially in a point symmetric positional relation when viewed in a perpendicular direction DB2 perpendicular to the central axis JB1 in the longitudinal direction of the limb B.

10 Claims, 29 Drawing Sheets

(56) References Cited

U.S. PATENT DOCUMENTS

| | | | | | |
|---|---|---|---|---|---|
| 4,966,365 | A * | 10/1990 | Winston | A63B 21/065 482/105 |
| 5,127,891 | A * | 7/1992 | Winston | A63B 21/065 482/105 |
| 5,300,000 | A * | 4/1994 | Schwartz | A63B 21/0607 482/105 |
| 5,683,335 | A * | 11/1997 | Groves | A43B 19/005 482/105 |
| 5,704,883 | A * | 1/1998 | Eckmann | A63B 21/065 482/105 |
| 6,007,461 | A | 12/1999 | Winston | |
| 6,200,244 | B1 | 3/2001 | Cook | |
| 6,557,176 | B2 * | 5/2003 | Franco-Sion | A63B 21/065 2/102 |
| 7,090,624 | B1 * | 8/2006 | Chrishon | A63B 21/0601 482/105 |
| 7,354,385 | B2 | 4/2008 | Virji et al. | |
| 9,339,067 | B2 * | 5/2016 | Feuchs | A41D 13/065 |
| 2008/0280737 | A1 * | 11/2008 | Cook | A63B 21/065 482/105 |
| 2010/0000006 | A1 * | 1/2010 | Butler | A63B 21/0605 2/160 |
| 2010/0311551 | A1 * | 12/2010 | Winston | A63B 21/0605 482/105 |

FOREIGN PATENT DOCUMENTS

| | | | |
|---|---|---|---|
| JP | 3070175 | U | 7/2000 |
| JP | 2000-334068 | A | 12/2000 |
| JP | 3201144 | U | 11/2015 |

* cited by examiner

LIMB TRAINING MACHINE

TECHNICAL FIELD

The present invention relates to a limb training machine worn on a limb such as an arm or a leg to apply a load to the limb.

BACKGROUND ART

Conventionally, there is known a limb training machine windingly worn on a limb such as an arm or a leg using a hook-and-loop fastener provided on both ends of a belt while housing a weight (sinker) inside the belt (for example, refer to Patent Document 1). A user may perform running, jogging, or walking and shake (turn) the limb while wearing the limb training machine, so that a load can be applied to the limb by means of a gravitational weight of the weight, and training can be performed to increase a muscular strength of the limb.

However, in a case where a user turns the limb while wearing the limb training machine, a user is easily burdened with a load physically and mentally. Specifically, in a case where a user turns the limb while wearing the limb training machine, a user adjusts (corrects) directivity, speed, periodicity (rhythm), and the like for a movement of the limb training machine in an unconscious state. These burden a mental load because adjustment is performed in an unconscious state. In addition, they unnecessarily burden a physical load if the adjustment is imperfect. As a result, a user may be easily fatigued or troubled disadvantageously.

Patent Document 1: JP 3070175 U

DISCLOSURE OF THE INVENTION

Problems to be Solved by the Invention

If such an unnecessary mental or physical load can be reduced, a user can efficiently perform training for a limb. Therefore, it is demanded to provide a limb training machine capable of allowing a user to efficiently perform training for a limb by reducing an unnecessary mental or physical load.

An object of the invention is to provide a limb training machine capable of allowing a user to efficiently perform training for a limb by reducing an unnecessary mental or physical load.

Means for Solving the Problems

According to an aspect of the invention, there is provided a limb training machine including: a wearable main body unit wearable on a limb; and first and second weights installed in the wearable main body unit, a load being applied to the limb by means of gravitational weights of the first and second weights in a wearing state, in which the first and second weights are arranged substantially in a point symmetric positional relationship as seen in a perpendicular direction perpendicular to a central axis of a longitudinal direction of the limb in the wearing state.

The wearable main body unit may be divided into a first weight placement region in which the first weight is arranged, a second weight placement region in which the second weight is arranged, and an intermediate region between the first and second weight placement regions in an axial direction along the central axis, and the intermediate region may have an elastic property.

The intermediate region may have a through-opening for inserting a thumb.

The first and second weight placement regions and the intermediate region may be connectable or separable.

The first weight placement region may have a first pouch portion, and the second weight placement region may have a second pouch portion. The first weight may be housed in the first pouch portion, and the second weight may be housed in the second pouch portion.

The first weight placement region and the intermediate region may respectively have fasteners engaged with each other, and the second weight placement region and the intermediate region may respectively have fasteners engaged with each other.

The wearable main body unit may have a belt-shaped zonal main body and first and second pouch portions arranged on one side surface of the zonal main body. The first weight may be housed in the first pouch portion, and the second weight may be housed in the second pouch portion.

The wearable main body unit may have fasteners engaged with each other near both longitudinal ends of the zonal main body.

Assuming that the limb training machine is sectioned into four quadrants as seen in the perpendicular direction in the wearing state, the first weight may be included only in one quadrant of the four quadrants, and the second weight may be included only in another quadrant of the four quadrants.

The first and second weights may be integrated with each other.

Effects of the Invention

According to the present invention, it is possible to provide a limb training machine capable of allowing a user to efficiently perform training for a limb by reducing an unnecessary mental or physical load.

PREFERRED MODE FOR CARRYING OUT THE INVENTION

Figure 1:
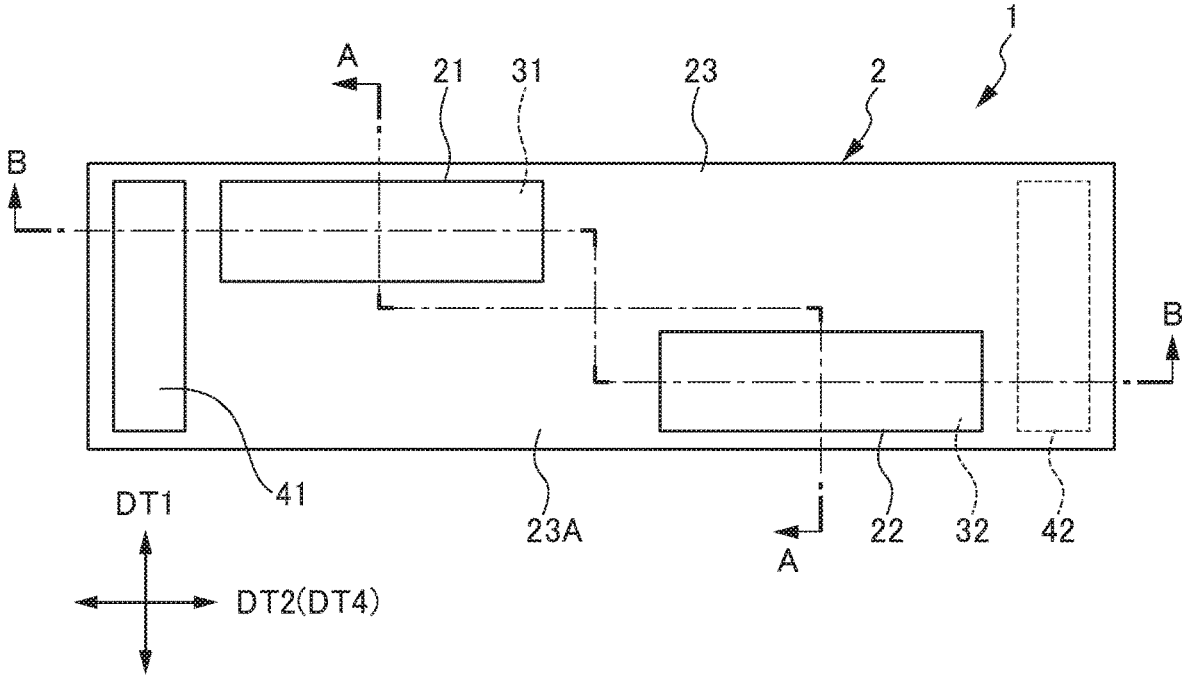
FIG. 1 is a front view illustrating a limb training machine 1 according to a first embodiment of the invention in an unfolded state.
Figure 2:
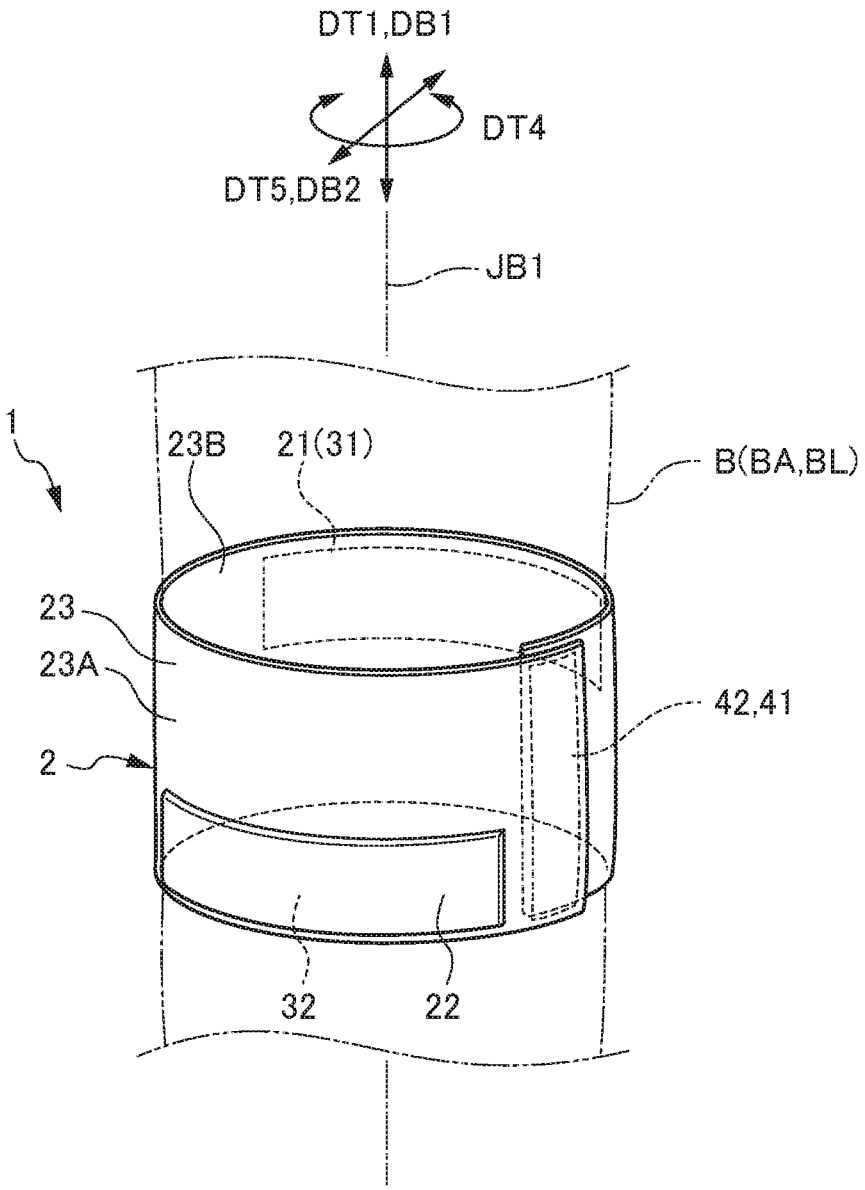
FIG. 2 is a perspective view illustrating the limb training machine 1 worn on a limb B.
Figure 3:
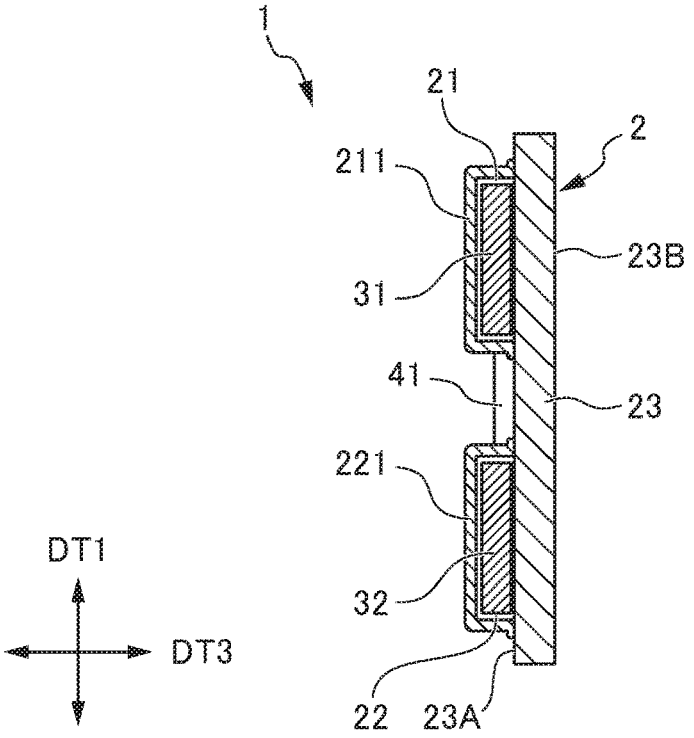
FIG. 3 is a cross-sectional view taken along a line A-A of FIG. 2.
Figure 4:
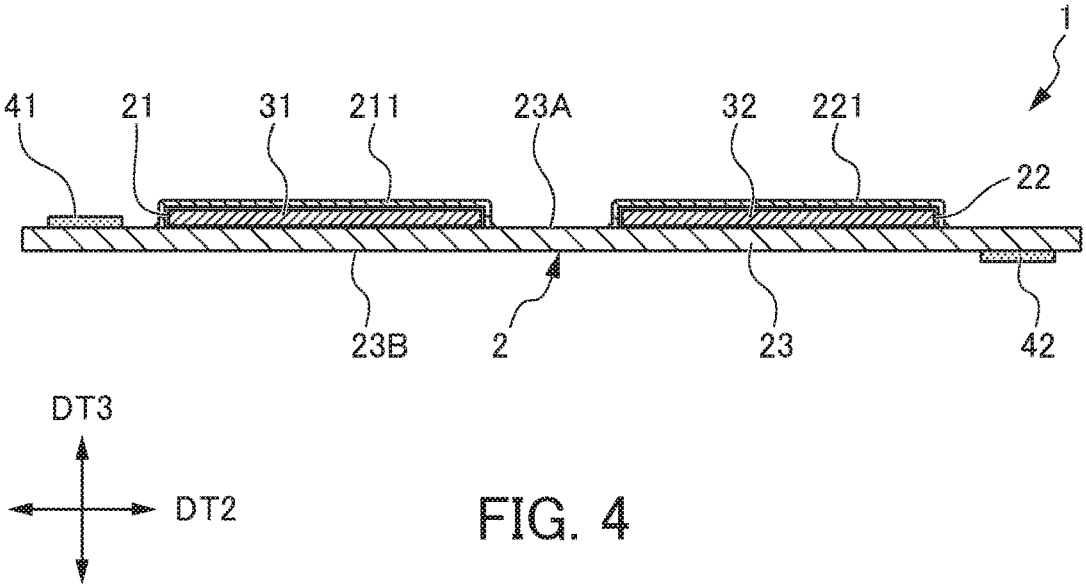
FIG. 4 is a cross-sectional view taken along a line B-B of FIG. 2.
Figure 5:
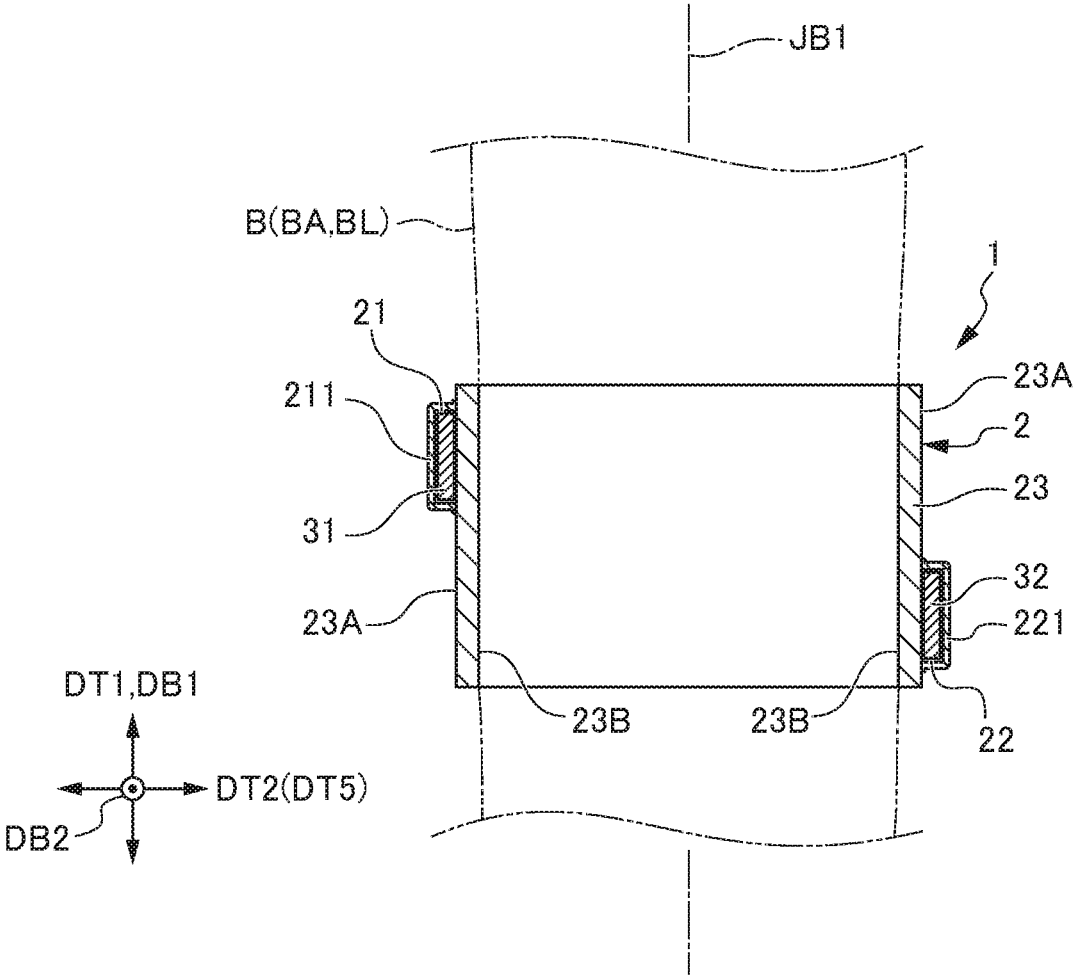
FIG. 5 is a longitudinal cross-sectional view illustrating the limb training machine 1 in a wearing state.
Figure 6:
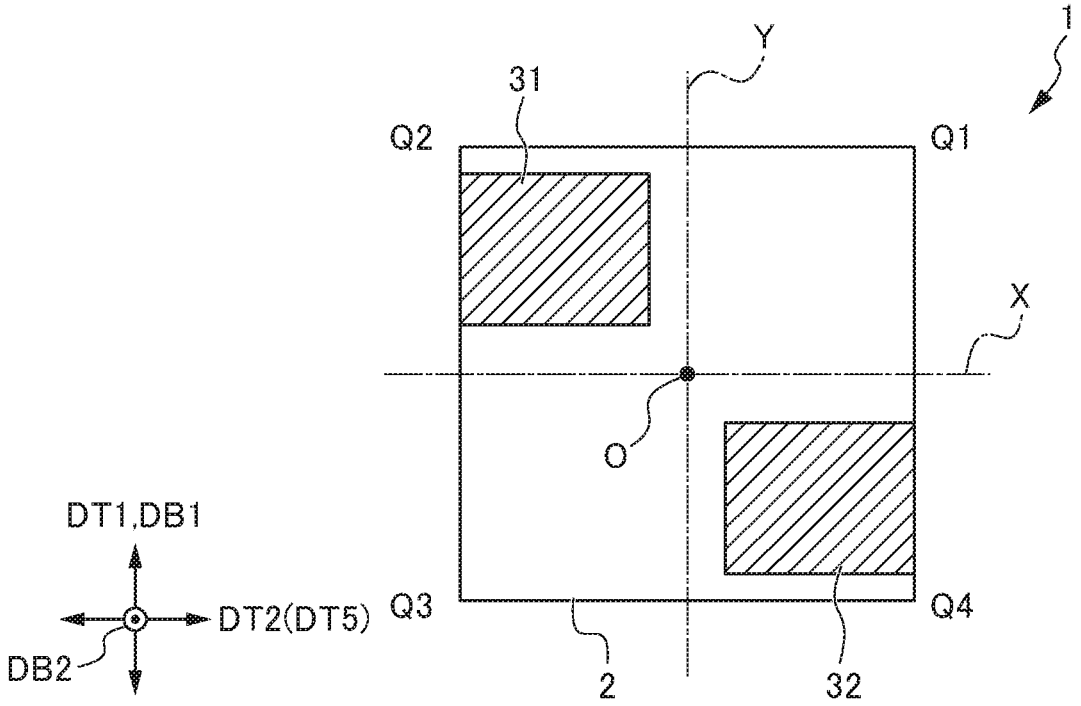
FIG. 6 is a diagram schematically illustrating positions of weights 31 and 32 sectioned into four quadrants.

A limb training machine 1 according to a first embodiment of the invention will be described in details with reference to the accompanying drawings. FIG. 1 is a front view illustrating a limb training machine 1 according to a first embodiment of the invention in an unfolded state. FIG. 2 is a perspective view illustrating the limb training machine 1 worn on a limb B. FIG. 3 is a cross-sectional view taken along a line A-A of FIG. 2. FIG. 4 is a cross-sectional view taken along a line B-B of FIG. 2. FIG. 5 is a longitudinal cross-sectional view illustrating the limb training machine 1 in a wearing state. FIG. 6 is a diagram schematically illustrating positions of the weights 31 and 32 sectioned into four quadrants.

As illustrated in FIGS. 1 and 2, the limb training machine 1 according to the invention is worn on a limb B such as an arm BA or a leg BL. A user performs running, jogging, walking, muscular training at home or office, rehabilitation, and the like while wearing the limb training machine 1 on the limb B (wearing state). A user may apply a load to the limb B by means of the gravitational weight of first and second weights 31 and 32 (described below) and perform training to increase a muscular strength of the limb B by shaking (turning) the limb B.

For simplicity purposes, it is assumed that the arm BA is divided into a hand BA6, a wrist BA4, a forearm BA2, an elbow BA3, an upper arm BA1, and a root BA5 over fingers. In addition, the leg BL is divided into a foot BL5, an ankle BL4, a calf BL2, a knee BL3, and a thigh BL1 over a foot sole. The arm BA and the leg BL may be divided in various ways. For example, the calf BL2 may be called a shin.

As illustrated in FIGS. 1 to 6, the limb training machine 1 has a wearable main body unit 2 wearable on the limb B, and first and second weights 31 and 32 installed in the wearable main body unit 2. The wearable main body unit 2 has a belt-shaped zonal main body 23, a first pouch portion 21, a second pouch portion 22, a first hook-and-loop fastener 41, and a second hook-and-loop fastener 42.

The zonal main body 23 has one or a plurality of belt-shaped materials or an additional reinforcing member. Since the zonal main body 23 is tightly wound around the limb B, the zonal main body 23 preferably has an excellent tactile feeling and an elastic property.

The first and second pouch portions 21 and 22 are provided on one side surface 23A of the zonal main body 23, and are not provided on the other side surface 23B of the zonal main body 23. The first pouch portion 21 houses the first weight 31, and the second pouch portion 22 houses the second weight 32. The first and second pouch portions 21 and 22 are arranged along the longitudinal direction DT2 of the zonal main body 23 at a predetermined interval. The first and second pouch portions 21 and 22 are offset in the width direction DT1 of the zonal main body 23 (without being overlapped). Specifically, assuming that the zonal main body 23 is bisected in the width direction DT1, the first pouch portion 21 is arranged in one of the bisected regions, and the second pouch portion 22 is arranged in the other bisected region.

As illustrated in FIGS. 3 and 4, the first pouch portion 21 is formed in a pouch shape by installing a first pouch forming piece 211 on one side surface 23A of the zonal main body 23. The second pouch portion 22 is formed in a pouch shape by installing a second pouch forming piece 212 on one side surface 23A of the zonal main body 23.

The first and second weights 31 and 32 serve as a weight (added to increase a gravitational weight of an article) or a weight (weighing object) formed of a material well known in the art. The first and second weights 31 and 32 may include one or a plurality of metal (lead) plates or various granules having a high specific gravity.

The first hook-and-loop fastener 41 is arranged on one side surface 23A of the zonal main body 23, and the second hook-and-loop fastener 42 is arranged on the other side surface 23B of the zonal main body 23. The first and second hook-and-loop fasteners 41 and 42 are fasteners respectively arranged near both ends of the longitudinal direction DT2 of the zonal main body 23 and engaged with each other. The first and second hook-and-loop fasteners 41 and 42 are arranged outward of the first and second pouch portions 21 and 22 in the longitudinal direction DT2 of the zonal main body 23.

The first hook-and-loop fastener 41 is, for example, a male hook-and-loop fastener. The second hook-and-loop fastener 42 is, for example, a female hook-and-loop fastener engageable with the male hook-and-loop fastener. Alternatively, the zonal main body 23 itself (for example, the other side surface 23B) may be used as the female hook-and-loop fastener without providing the second hook-and-loop fastener 42 separately from the zonal main body 23.

As illustrated in FIG. 2, by engaging the first and second hook-and-loop fasteners 41 and 42 with each other, the wearable main body unit 2 can be formed in a ring shape. The first and second weights 31 and 32 are curved in the circumferential direction DT4. The first and second weights 31 and 32 may have a rectangular planar shape in the unfolded state of FIG. 1. The first and second weights 31 and 32 may be curved in the wearing state of FIG. 2 or may be curved in advance in the unfolded state of FIG. 1.

By causing the limb training machine 1 to abut on the limb B (for example, arm BA) and engaging the first and second hook-and-loop fasteners 41 and 42 with each other, the limb training machine 1 can be windingly worn on the limb B. Focusing on a radial direction DT5 of the limb training machine 1 (radial direction DB2 of the limb B) in the wearing state as illustrated in FIGS. 2 and 5, the zonal main body 23 is arranged inward in the radial direction DT5, and the first and second weights 31 and 32 are arranged outward in the radial direction DT5.

Note that the wearable main body unit 2 may be formed in a ring shape in advance. In this case, the ring-shaped wearable main body unit 2 is inserted into the limb B from the outside and is worn on the limb B.

Arrangement positions of the first and second weights 31 and 32 will be described in details. As illustrated in FIG. 6, as seen in a perpendicular direction DB2 (radial direction DT5) perpendicular to a central axis JB1 (axial direction DB1) of the longitudinal direction of the limb B in the wearing state, the first and second weights 31 and 32 are arranged substantially in a point symmetric positional relationship.

Specifically, assuming that the wearable main body unit 2 has a rectangular shape as seen in the perpendicular direction DB2 (radial direction DT5), the radial direction DT5 is set to an X-axis, the width direction DT1 is set to a Y-axis, and an intersection between the X-axis and the Y-axis is set to the origin O. In this case, the X-Y plane is in parallel with a virtual plane formed in the shaking (turning) direction of the limb B. The four regions sectioned by the X and Y axes are referred to as first, second, third, and fourth quadrants Q1, Q2, Q3, and Q4 counterclockwise. Specifically, assuming that the limb training machine 1 is sectioned into four quadrants (first, second, third, and fourth quadrants Q1, Q2, Q3, and Q4) as seen in the perpendicular direction DB2 (radial direction DT5) in the wearing state, the first weight 31 is included only in one quadrant (second quadrant Q2) of the four quadrants Q1 to Q4, and the second weight 32 is included only in another quadrant (fourth quadrant Q4) of the four quadrants Q1 to Q4.

Figure 7:
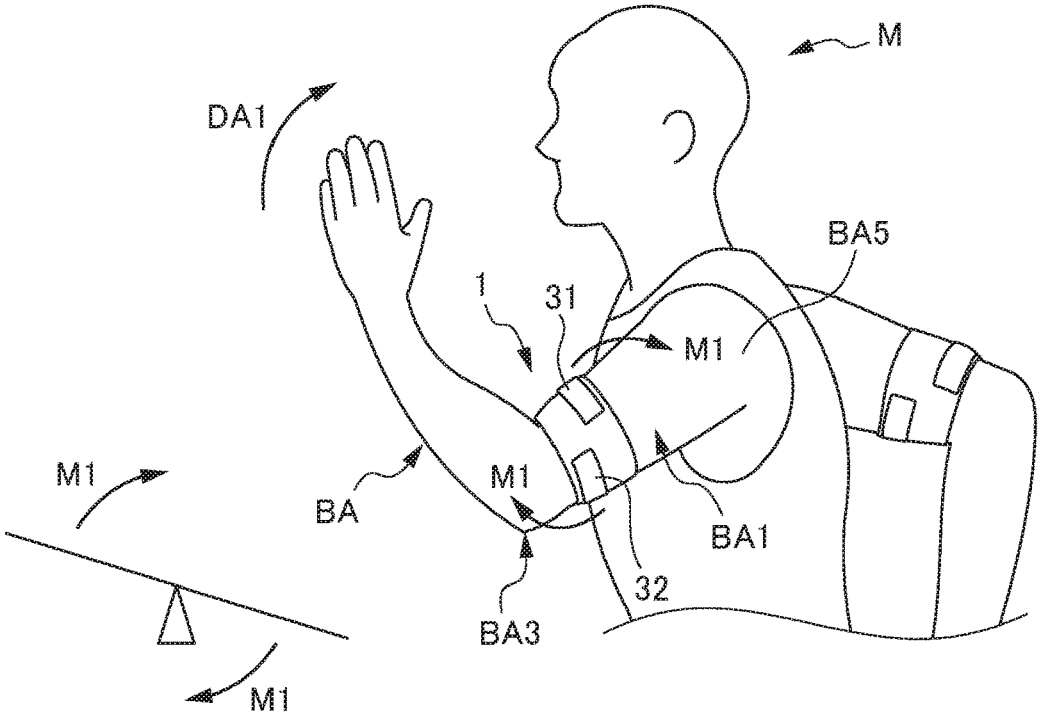
FIG. 7 is a diagram illustrating a behavior for shaking an arm BA upward while the limb training machine 1 is worn on an upper arm BA1 over an elbow BA3.
Figure 8:
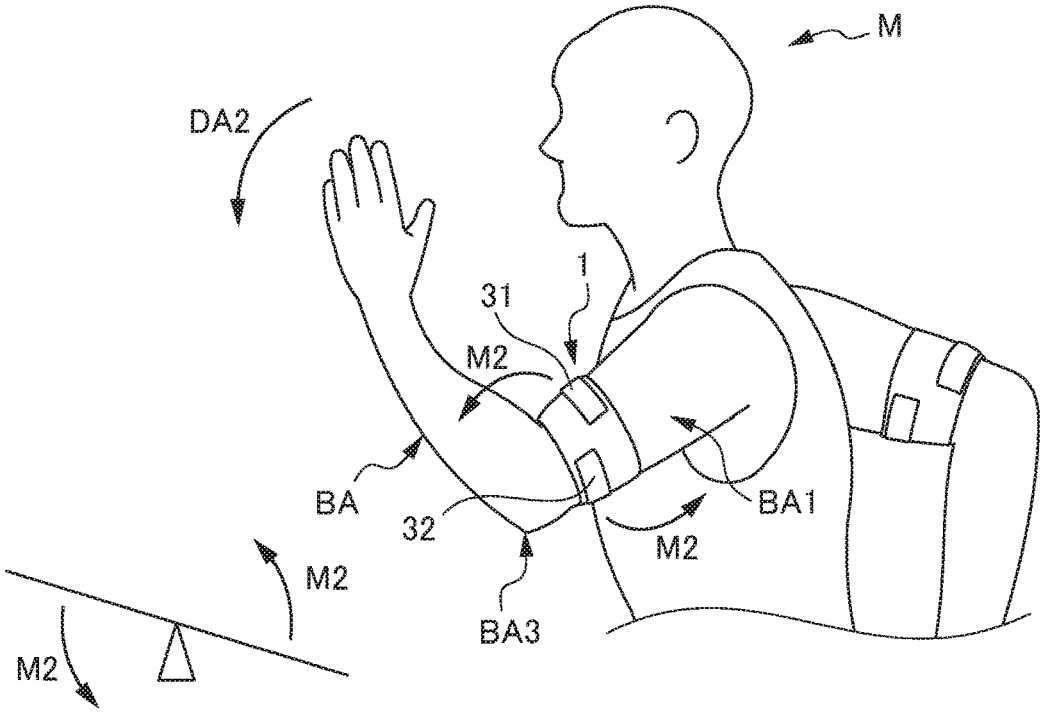
FIG. 8 is a diagram illustrating a behavior for shaking the arm BA downward from the state of FIG. 7.

Next, a method of using the limb training machine 1 and effects thereof will be described with reference to the accompanying drawings. FIG. 7 is a diagram illustrating a behavior when a user shakes the arm BA upward while wearing the limb training machine 1 on the upper arm BA1 over the elbow BA3. FIG. 8 is a diagram illustrating a behavior when a user shakes the arm BA downward from the state of FIG. 7.

As illustrated in FIGS. 7 and 8, the limb training machine 1 is worn on the upper arm BA1 over the elbow BA3. In this wearing state, the first weight 31 is arranged in the front upper side of the user M, and the second weight 32 is arranged in the rear lower side of the user M. Note that, in this case, the upper, lower, front, and rear directions are set with respect to the arm BA when the arm BA hangs down. The user M shakes the arm BA while running or walking in the wearing state. That is, the limb training machine 1 turns reciprocatingly with respect to the root BA5 of the arm BA.

When the arm BA is shaken to turn frontward and upward as illustrated in FIG. 7, a rotational moment (centrifugal force) M1 is generated from the limb training machine 1 (first weight 31, second weight 32) codirectionally with the turning direction DA1 of the arm BA. For this reason, frontward and upward shaking (turning) of the arm BA is promoted. Inversely, when the arm BA is shaken to turn rearward and downward as illustrated in FIG. 8, a rotational moment (centrifugal force) M2 is generated from the limb training machine 1 (first weight 31, second weight 32) codirectionally with the turning direction DA2 of the arm BA. For this reason, rearward and downward shaking (turning) of the arm BA is promoted.

Using the limb training machine 1 according to the first embodiment, for example, the following effects can be achieved. As illustrated in FIGS. 5 and 6, according to the first embodiment, as seen in the perpendicular direction DB2 perpendicular to the central axis JB1 of the longitudinal direction of the limb B in the wearing state, the first and second weights 31 and 32 are arranged substantially in a point symmetric positional relationship. For this reason, when the limb B on which the limb training machine 1 is worn is turned or the like, a rotational moment (centrifugal force) M1 or M2 is generated from the limb training machine 1 (first weight 31, second weight 32) codirectionally with the turning direction DA1 or DA2 of the arm BA as illustrated in FIGS. 7 and 8. For this reason, shaking (turning) of the arm BA is promoted.

Therefore, by generating an initial movement of the limb training machine 1, it is possible to easily maintain direction, speed, periodicity (rhythm), or the like for the movement of the limb training machine 1 by virtue of inertia (centrifugal force) of the first and second weights 31 and 32. Even when the direction, speed, periodicity (rhythm), or the like is deviated for the movement of the limb training machine 1, a turning direction of the limb training machine 1 is corrected. Therefore, it is possible to suppress a user from adjusting the movement of the limb training machine 1 in an unconscious state in order to correct direction, speed, periodicity (rhythm), or the like for the movement of the limb training machine 1. Furthermore, it is possible to suppress a mental load. In addition, it is possible to reduce an unnecessary physical load caused by imperfect adjustment. In this manner, according to the first embodiment, it is possible to provide a limb training machine capable of allowing a user to efficiently perform training for a limb by reducing an unnecessary mental or physical load.

According to the first embodiment, assuming that the limb training machine 1 is sectioned into four quadrants as seen in the perpendicular direction DB2 in the wearing state, the first weight 31 is included only in one quadrant (second quadrant Q2) of the four quadrants, and the second weight 32 is included only in another quadrant (fourth quadrant Q4) of the four quadrants. For this reason, gravitational weights of the first and second weights 31 and 32 are efficiently applied to generate a rotational moment (centrifugal force). Therefore, the aforementioned effects can be more efficiently achieved.

Figure 9A:
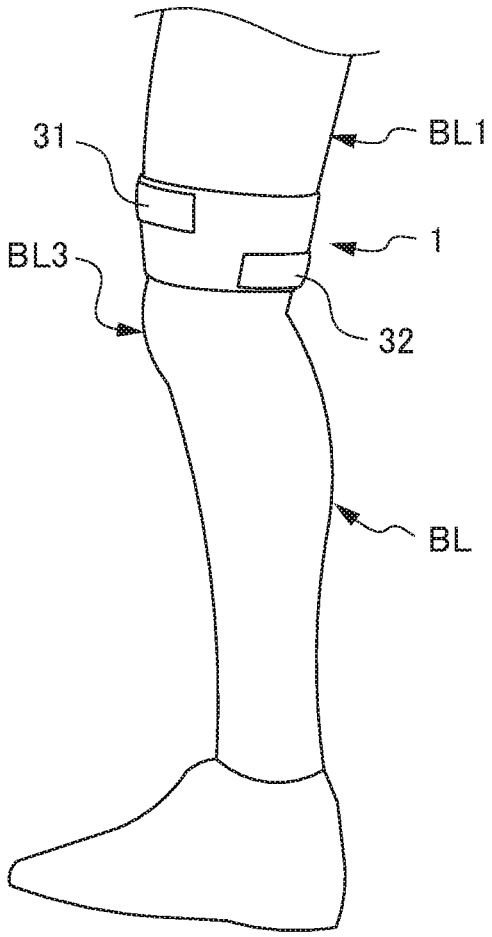
FIG. 9A is a diagram illustrating a state in which the limb training machine 1 is worn on a thigh BL1 over a knee BL3.
Figure 9B:
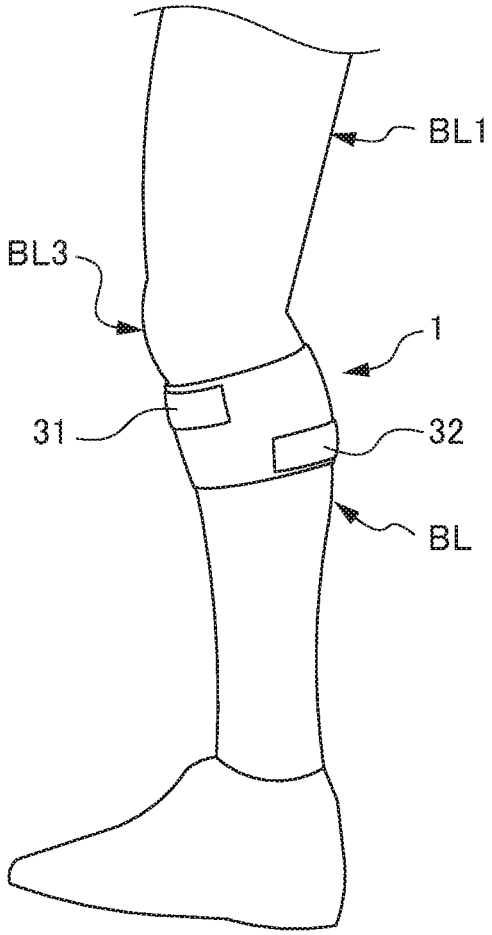
FIG. 9B is a diagram illustrating a state in which the limb training machine 1 is worn on a calf BL2 under the knee BL3.
Figure 9C:
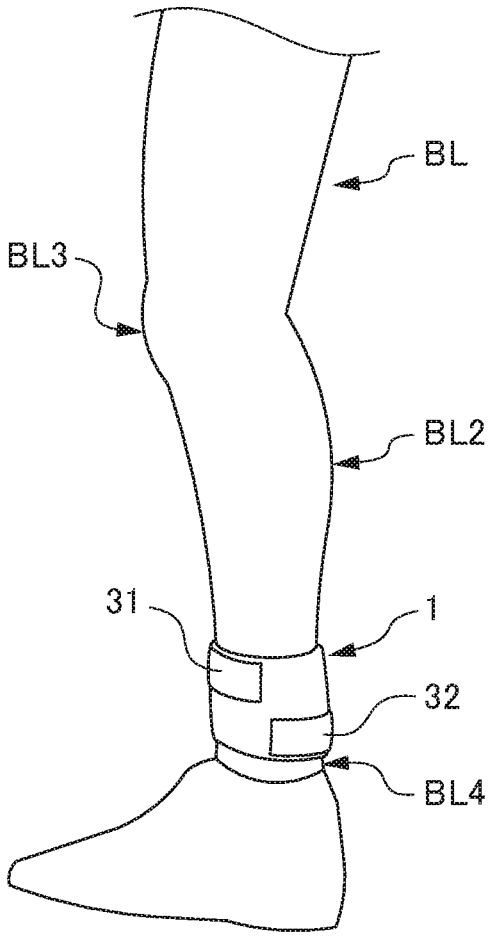
FIG. 9C is a diagram illustrating a state in which the limb training machine 1 is worn on a calf BL2 over an ankle BL4.
Figure 10A:
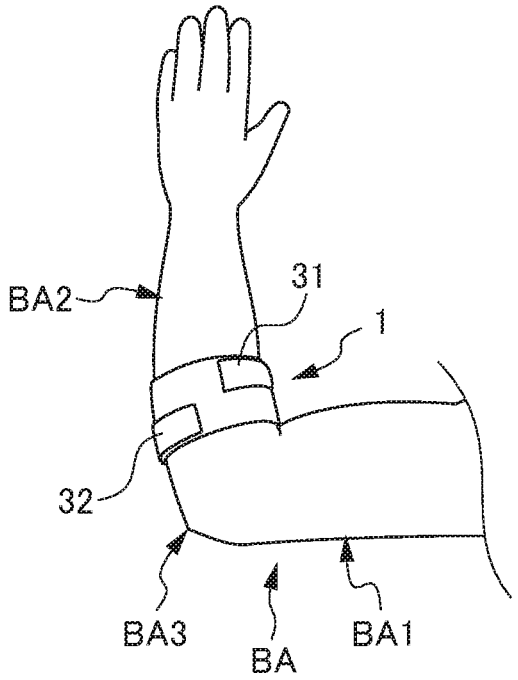
FIG. 10A is a diagram illustrating a state in which the limb training machine 1 is worn on a forearm BA2 under an elbow BA3.
Figure 10B:
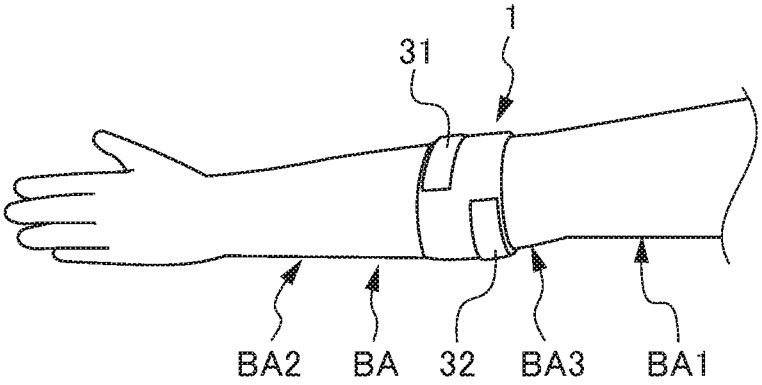
FIG. 10B is a diagram illustrating a state in which the arm BA is linearly reached out from the state of FIG. 10A.

Next, variations in a wearing position, a wearing direction, or the like of the limb training machine 1 according to the invention will be described. The limb training machine 1 according to the invention can be used to achieve the effects similar to those of the aforementioned embodiment even when the wearing position, the wearing direction, or the like is changed. FIG. 9A is a diagram illustrating a state in which the limb training machine 1 is worn on a thigh BL1 over a knee BL3. FIG. 9B is a diagram illustrating a state in which the limb training machine 1 is worn on a calf BL2 under the knee BL3. FIG. 9C is a diagram illustrating a state in which the limb training machine 1 is worn on a calf BL2 over an ankle BL4. FIG. 10A is a diagram illustrating a state in which the limb training machine 1 is worn on a forearm BA2 under an elbow BA3. FIG. 10B is a diagram illustrating a state in which the arm BA is linearly reached out from the state of FIG. 10A.

As illustrated in FIG. 9A, the limb training machine 1 may be worn on a thigh BL1 over a knee BL3. The wearing direction is set as illustrated in FIGS. 7 and 8. That is, in the wearing state, the first weight 31 is arranged frontward and upward of a user, and the second weight 32 is arranged rearward and downward of a user. Note that, in this case, the front, rear, upper, and lower directions are set with respect to the leg BL standing upright. As illustrated in FIG. 9B, the limb training machine 1 may be worn on the calf BL2 under the knee BL3. The wearing direction is set as illustrated in FIG. 9A. As illustrated in FIG. 9C, the limb training machine 1 may be worn on the calf BL2 over the ankle BL4. The wearing direction is set as illustrated in FIG. 9A.

When the turning direction for applying a load is opposite, the wearing direction is also set oppositely. For example, in Japanese fencing, a user may shake (turn) a bamboo sword (not illustrated) frontward and downward from the upside with respect to the elbow BA3 in some cases of the exercise. In this case, the forearm BA2 is turned frontward and downward with respect to the elbow BA3. In this regard, the limb training machine 1 is worn on the forearm BA2 under the elbow BA3 oppositely to the wearing direction of FIGS. 7 and 8. That is, when the arm BA hangs down, the first weight 31 is arranged frontward and downward of a user, and the second weight 32 is arranged rearward and upward of a user.

In this state, a user shakes the forearm BA2 as illustrated in FIGS. 10A and 10B. That is, the limb training machine 1 is reciprocatingly turned with respect to the elbow BA3 of the arm BA. When the forearm BA2 is shaken to turn frontward and downward, a rotational moment (not illustrated) is generated from the limb training machine 1 (first weight 31, second weight 32) codirectionally with the turning direction of the forearm BA2. For this reason, frontward and downward shaking (turning) of the arm is promoted. Inversely, when the forearm BA2 is shaken to turn rearward and upward, a rotational moment (not illustrated) is generated from the limb training machine 1 (first weight 31, second weight 32) codirectionally with the turning direction of the arm BA. For this reason, rearward and upward shaking (turning) of the arm is promoted.

Figure 11A:
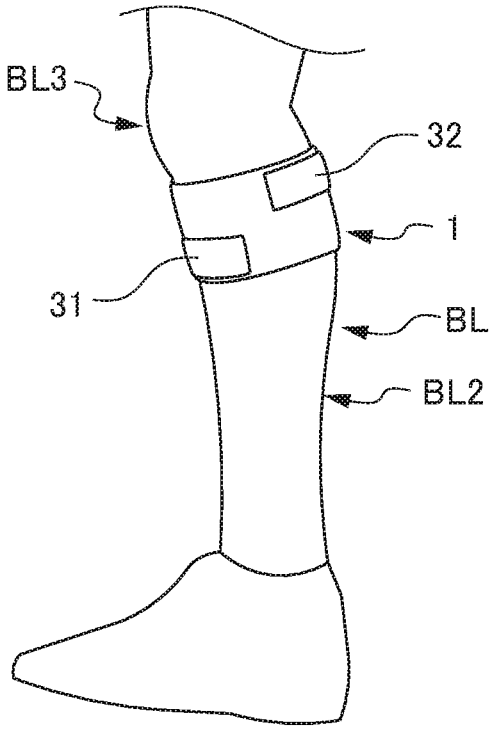
FIG. 11A is a diagram illustrating a state in which the limb training machine 1 is worn on the calf BL2 under the knee BL3 (in a wearing direction different from that of FIG. 9B).
Figure 11B:
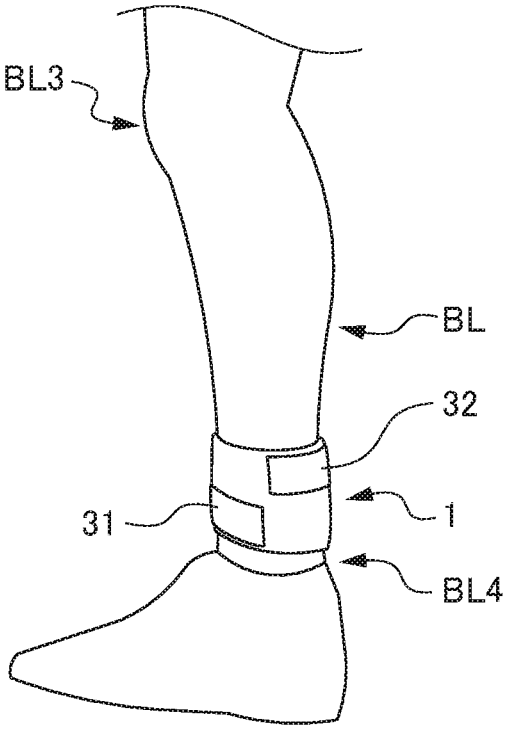
FIG. 11B is a diagram illustrating a state in which the limb training machine 1 is worn on the calf BL2 over the ankle BL4 (in a wearing direction different from that of FIG. 9C).

FIG. 11A is a diagram illustrating a state in which the limb training machine 1 is worn on the calf BL2 under the knee BL3 (in the wearing direction different from that of FIG. 9B). FIG. 11B is a diagram illustrating a state in which the limb training machine 1 is worn on the calf BL2 over the ankle BL4 (in the wearing direction different from that of FIG. 9C). As illustrated in FIG. 11A, the limb training machine 1 may be worn on the calf BL2 under the knee BL3. The wearing direction is opposite to that of FIG. 9B. This wearing direction is effective when the calf BL2 is raised (turned) rearward and upward with respect to the knee BL3 of the leg BL. As illustrated in FIG. 11B, the limb training machine 1 may be worn on the calf BL2 over the ankle BL4. The wearing direction is opposite to that of FIG. 9C. This wearing direction is effective when the calf BL2 is raised (turned) rearward and upward with respect to the knee BL3 of the leg BL.

Figure 12:
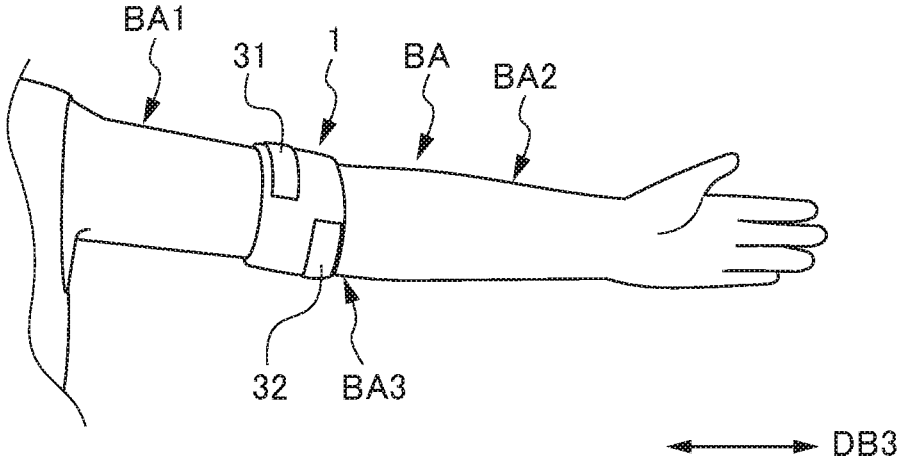
FIG. 12 is a diagram illustrating a state in which the limb training machine 1 is worn on the upper arm BA1 over the elbow BA3 to shake the arm BA in a right-left direction DB3.

The limb training machine 1 may also be applied to turning in the right-left direction (horizontally) DB3 of a user. FIG. 12 is a diagram illustrating a state in which the limb training machine 1 is worn on the upper arm BA1 over the elbow BA3 to shake the arm BA in the right-left direction DB3. For example, the limb training machine 1 is worn on the upper arm BA1 over the elbow BA3 as illustrated in FIG. 12. In the wearing state, the first weight 31 is arranged outward and upward in the horizontal direction DB3 of a user, and the second weight 32 is arranged inward and downward in the horizontal direction DB3 of a user. In this state, the user may turn the arm BA outward and upward in the horizontal direction DB3 of the user or may turn (reciprocatingly) the arm BA inward and downward in the horizontal direction DB3 of the user.

Figure 13A:
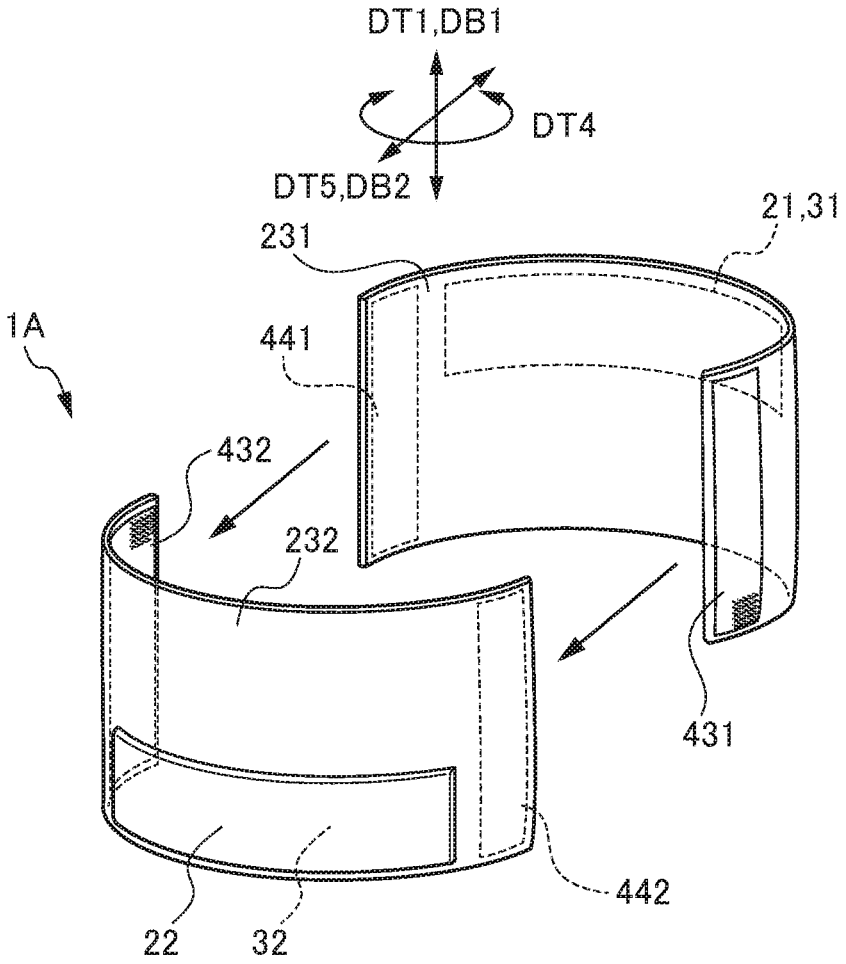
FIG. 13A is a perspective view illustrating a first modification 1A of the first embodiment in conjunction with FIG. 2.
Figure 13B:
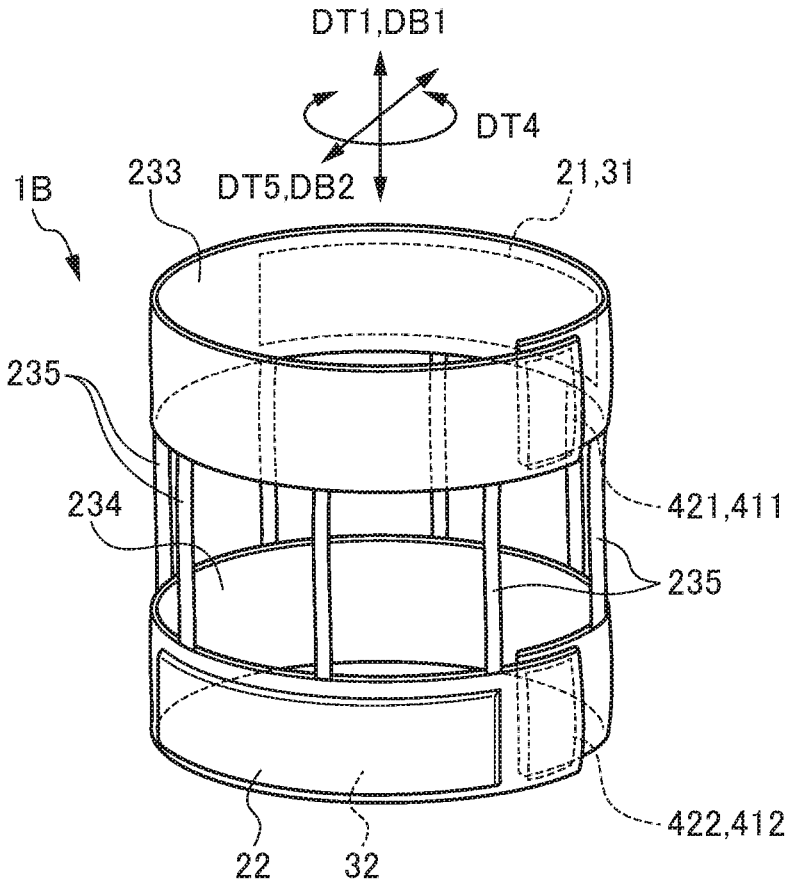
FIG. 13B is a perspective view illustrating a second modification 1B of the first embodiment in conjunction with FIG. 2.
Figure 14A:
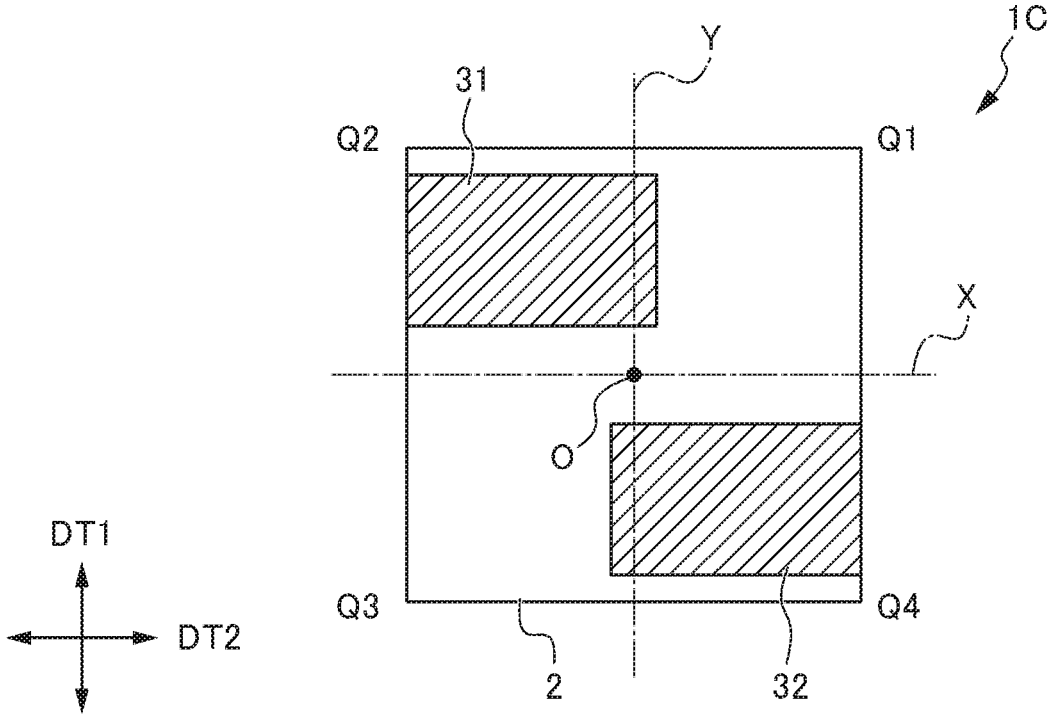
FIG. 14A is a diagram illustrating a third modification 1C of the first embodiment in conjunction with FIG. 6.
Figure 14B:
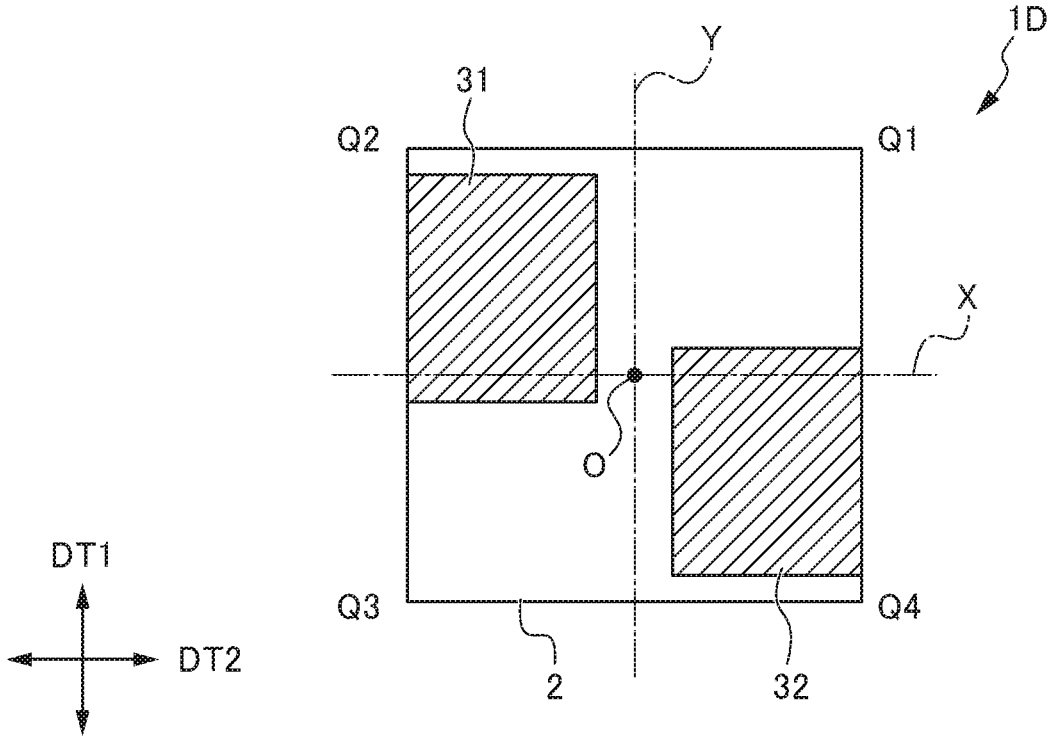
FIG. 14B is a diagram illustrating a fourth modification 1D of the first embodiment in conjunction with FIG. 6.

While a preferable embodiment of the invention has been described hereinbefore, the invention may be embodied in various forms without limiting to the aforementioned embodiments. Next, various modifications of the limb training machine according to the invention will be described. The description of the aforementioned embodiment will be appropriately applied or incorporated by reference into the modifications unless specified otherwise. FIGS. 13A and 13B correspond to FIG. 2, and FIG. 13A is a perspective view illustrating a first modification 1A of the first embodiment. FIG. 13B is a perspective view illustrating a second modification 1B of the first embodiment. FIGS. 14A and 14B correspond to FIG. 6. FIG. 14A is a diagram illustrating a third modification 1C of the first embodiment, and FIG. 14B is a diagram illustrating a fourth modification 1D of the first embodiment.

<First Modification of First Embodiment>

As illustrated in FIG. 13A, the first modification 1A of the first embodiment has a two-piece structure bisected in a circumferential direction DT4, compared to the first embodiment described above. Specifically, according to the first modification 1A of the first embodiment, the zonal main body of the wearable main body unit 2 includes a pair of nearly semicircular annular halved zonal main bodies 231 and 232. Male and female hook-and-loop fasteners 431 and 441 are respectively provided near both longitudinal ends of one of the halved zonal main bodies 231. Male and female hook-and-loop fasteners 432 and 442 are respectively provided near both longitudinal ends of the other halved zonal main body 232. The one halved zonal main body 231 is provided with the first pouch portion 21, and the first pouch portion 21 houses the first weight 31. The other halved zonal main body 232 is provided with the second pouch portion 22, and the second pouch portion 22 houses the second weight 32.

According to the first modification 1A of the first embodiment, the male hook-and-loop fastener 431 of the one halved zonal main body 231 and the female hook-and-loop fastener 442 of the other halved zonal main body 232 are engaged with each other. In addition, the male hook-and-loop fastener 432 of the other halved zonal main body 232 and the female hook-and-loop fastener 441 of the one halved zonal main body 231 are engaged with each other. As a result, the one halved zonal main body 231 and the other halved zonal main body 232 are coupled in a ring shape, so that the first modification 1A of the first embodiment becomes similar to the first embodiment in a functional sense. Note that the number of segments of the circumferential direction DT4 or the central angle of the member is not limited as long as they form a ring shape by coupling.

<Second Modification of First Embodiment>

As illustrated in FIG. 13B, according to the second modification 1B of the first embodiment, the zonal main body of the wearable main body unit 2 includes narrow half-width zonal main bodies 233 and 234 and a plurality of lines of stringy connecting members 235. The half-width zonal main bodies 233 and 234 are spaced in the width direction DT1. The stringy connecting members 235 connect an edge region of the half-width zonal main body 234 side of the half-width zonal main body 233 and an edge region of the half-width zonal main body 233 side of the half-width zonal main body 234 to each other. The stringy connecting members 235 have low stiffness. The number of the stringy connecting members 235 is set to, for example, 6 to 12.

Male and female hook-and-loop fasteners 411 and 421 are respectively provided near both longitudinal ends of the one half-width zonal main body 233. Male and female hook-and-loop fasteners 412 and 422 are respectively provided near both longitudinal ends of the other half-width zonal main body 234. The one half-width zonal main body 233 is provided with the first pouch portion 21, and the first pouch portion 21 houses the first weight 31. The other half-width zonal main body 234 is provided with the second pouch portion 22, and the second pouch portion 22 houses the second weight 32.

According to the second modification 1B of the first embodiment, the male and female hook-and-loop fasteners 411 and 421 of the one half-width zonal main body 233 are engaged with each other, and the male and female hook-and-loop fasteners 412 and 422 of the other half-width zonal main body 234 are engaged with each other. Since the half-width zonal main bodies 233 and 234 are connected to each other with the stringy connecting members 235, the positional relationship between the first and second weights 31 and 32 in the circumferential direction DT4 is constantly maintained. The stringy connecting member 235 also prevents separation between the half-width zonal main bodies 233 and 234. Note that the number of segments of the width direction DT1 or the width of the member is not limited as long as a ring shape can be formed by connecting the zonal main bodies. According to the second modification 1B of the first embodiment, the region where the stringy connecting members 235 are provided has a function similar to that of an intermediate region 1025 of limb training machine 101 of the second embodiment described below.

<Third Modification of First Embodiment>

In the first embodiment of FIG. 6, the first weight 31 is included only in one quadrant (second quadrant Q2), and the second weight 32 is included only in one quadrant (fourth quadrant Q4) of the other quadrants. However, the invention is not limited thereto. As illustrated in FIG. 14A, a part of the first weight 31 may be included in the first quadrant Q1, or a part of the second weight 32 may be included in the third quadrant Q3. In other words, the first weight 31 may extend across the second quadrant Q2 and the first quadrant Q1, and the second weight 32 may extend across the fourth quadrant Q4 and the third quadrant Q3.

<Fourth Modification of First Embodiment>

As illustrated in FIG. 14B, a part of the first weight 31 may be included in the third quadrant Q3, and a part of the second weight 32 may be included in the first quadrant Q1. In other words, the first weight 31 may extend across the second quadrant Q2 and the third quadrant Q3, and the second weight 32 may extend across the fourth quadrant Q4 and the first quadrant Q1.

Figure 15:
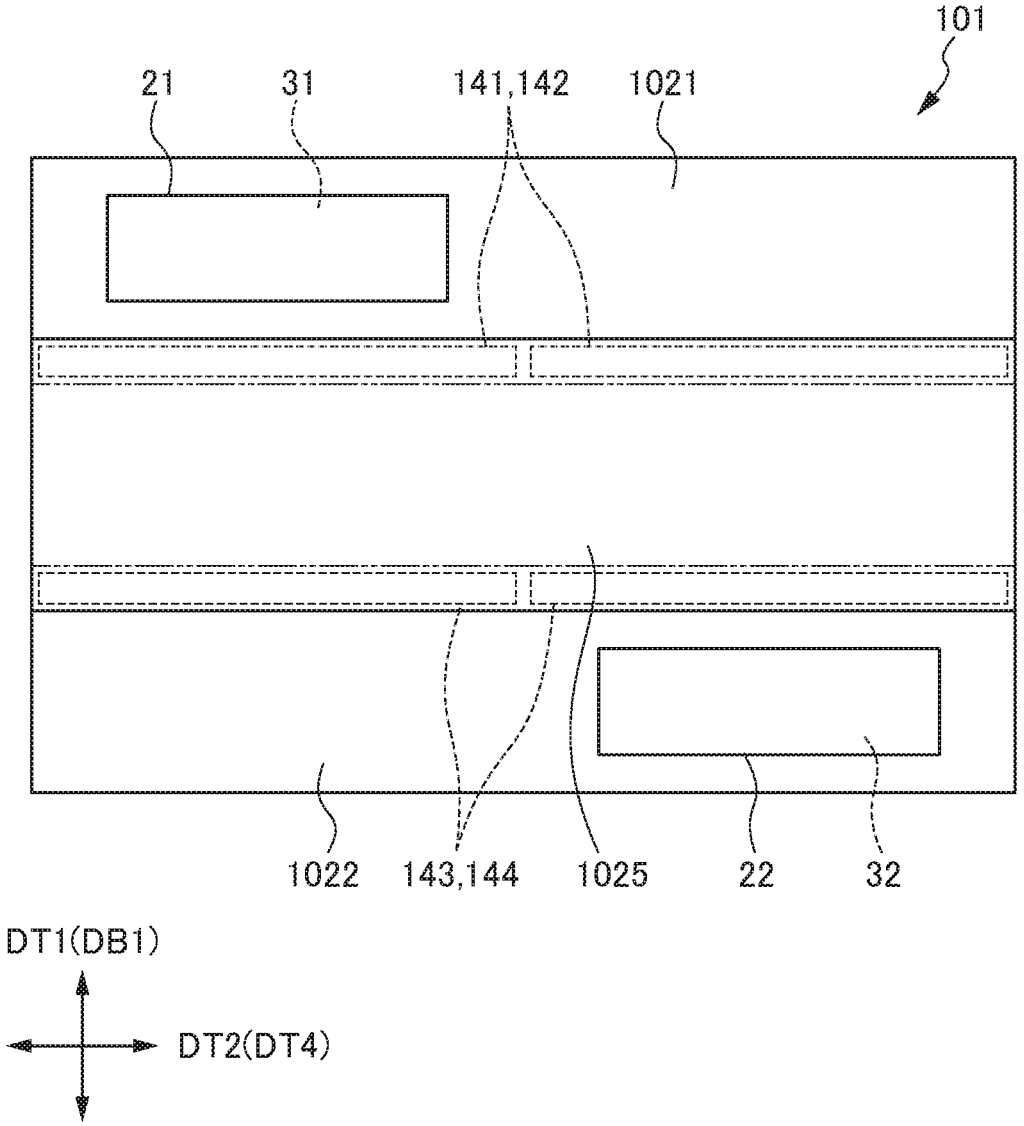
FIG. 15 is a front view illustrating a limb training machine 101 according to a second embodiment of the invention in an unfolded state.
Figure 16:
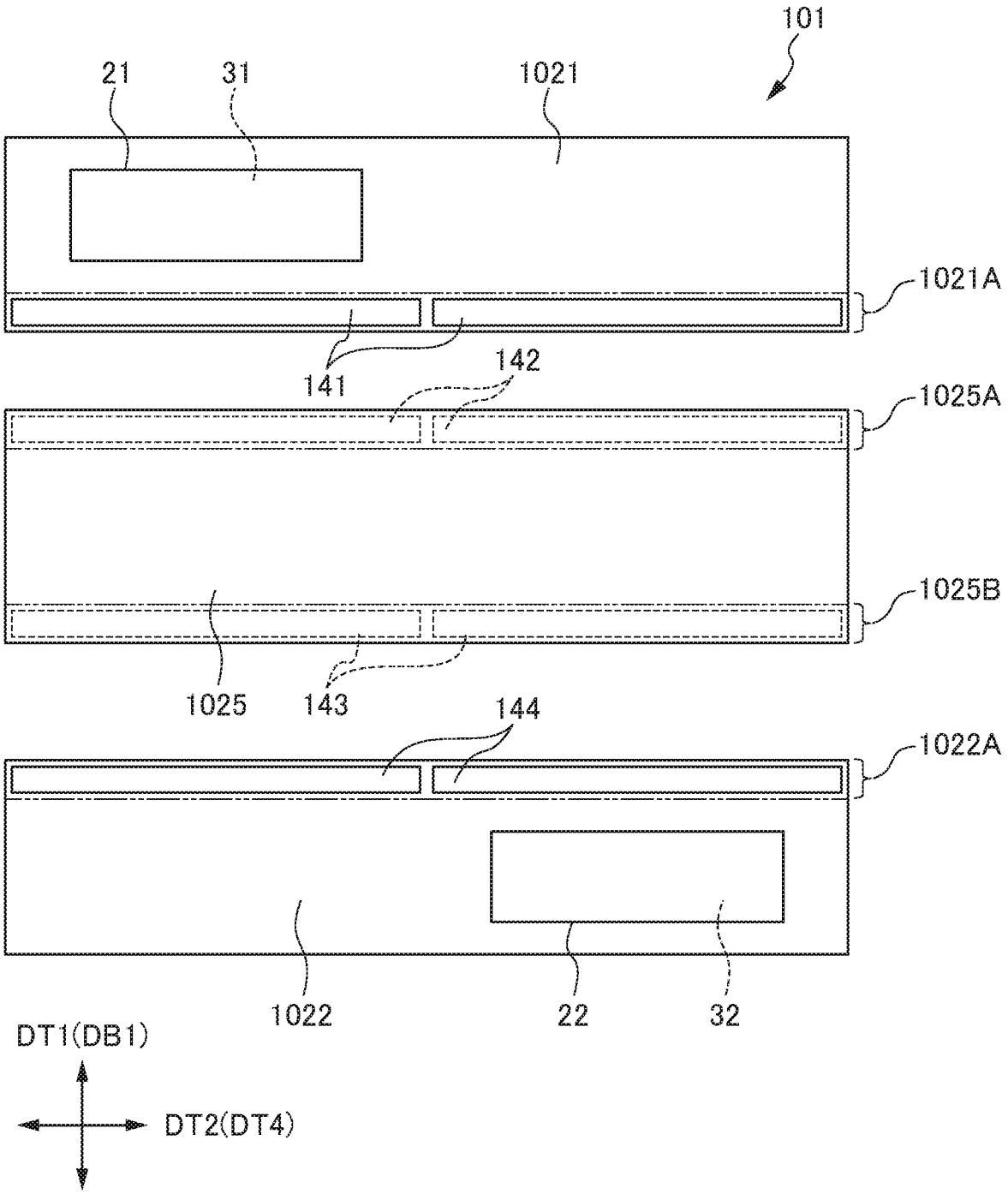
FIG. 16 is a front view illustrating the limb training machine 101 of FIG. 15 in a separated state.
Figure 17:
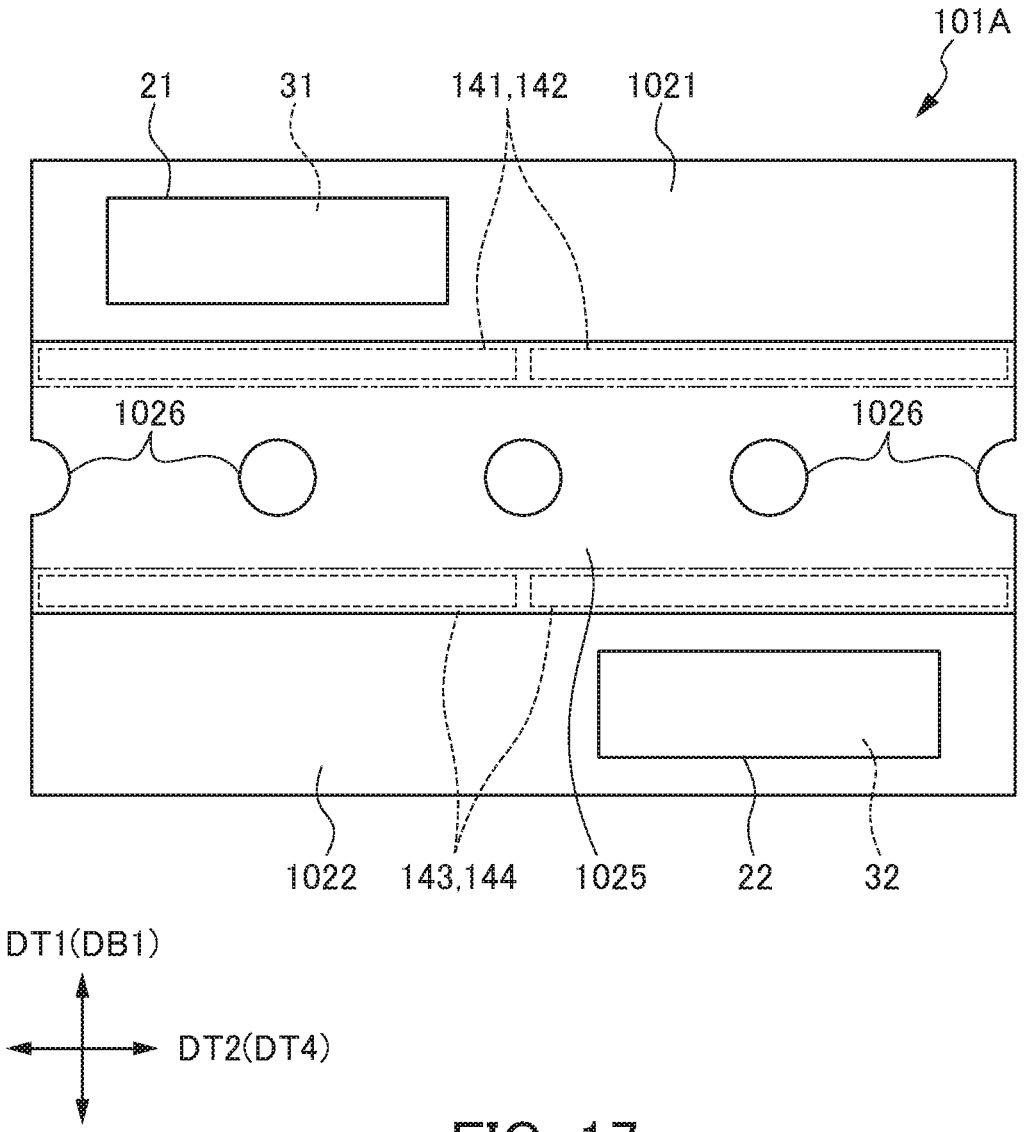
FIG. 17 is a diagram illustrating a first modification 101A of the second embodiment in conjunction with FIG. 15.

Next, another embodiment of the present invention will be described. The description of the first embodiment will be appropriately incorporated by reference into another embodiment unless specified otherwise. Another embodiment also has effects similar to those of the first embodiment. FIG. 15 is a front view illustrating the limb training machine 101 according to the second embodiment of the invention in an unfolded state. FIG. 16 is a front view illustrating the limb training machine 101 of FIG. 15 in a separated state. FIG. 17 is a diagram illustrating a first modification 101A of the second embodiment in conjunction with FIG. 15.

Figure 18A:
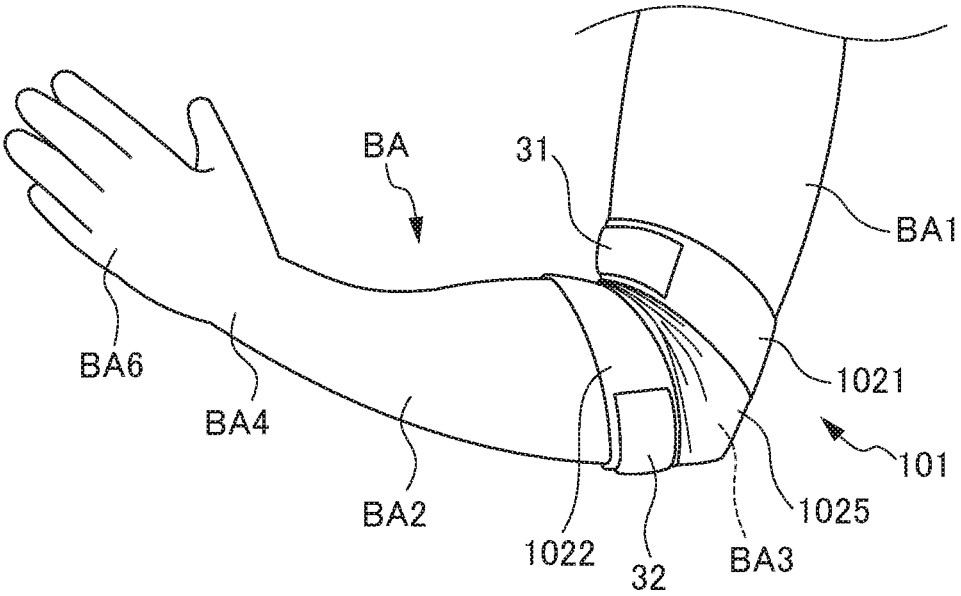
FIG. 18A is a diagram illustrating a state in which the limb training machine 101 according to the second embodiment is worn on the arm BA over the elbow BA3.
Figure 18B:
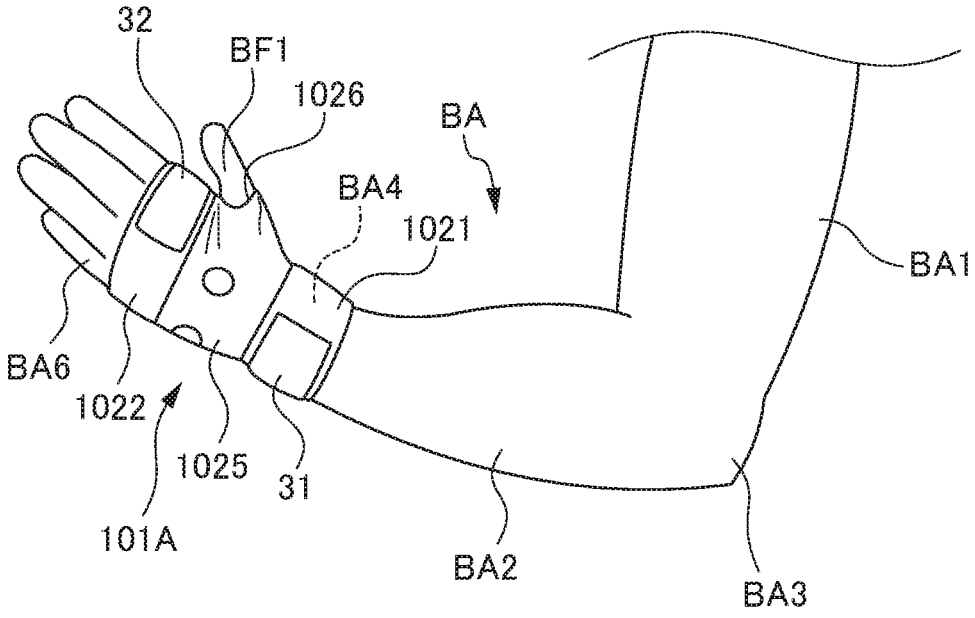
FIG. 18B is a diagram illustrating a state in which the first modification 101A of the second embodiment is worn around the wrist BA4.
Figure 19A:
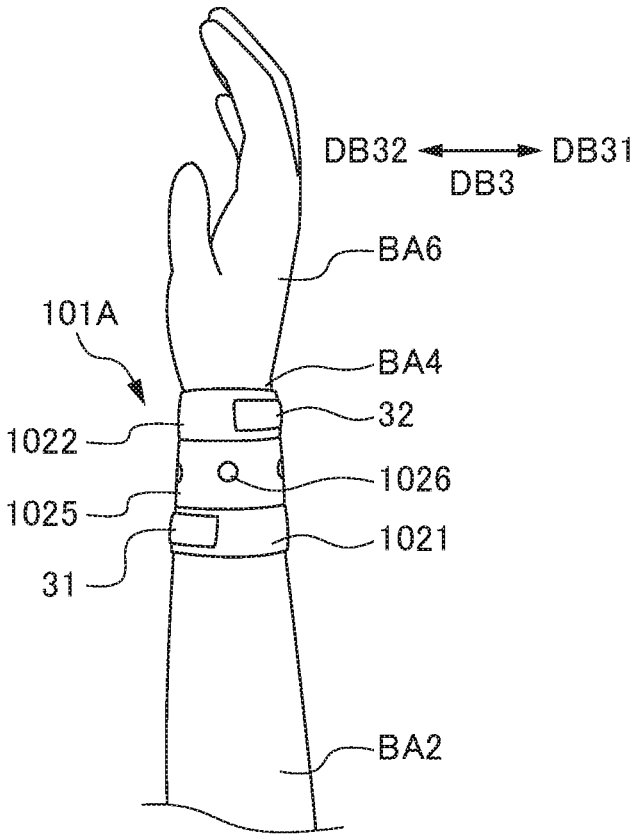
FIG. 19A is a diagram illustrating a state in which the first modification 101A of the second embodiment is worn on the forearm BA2 over the wrist BA4.
Figure 19B:
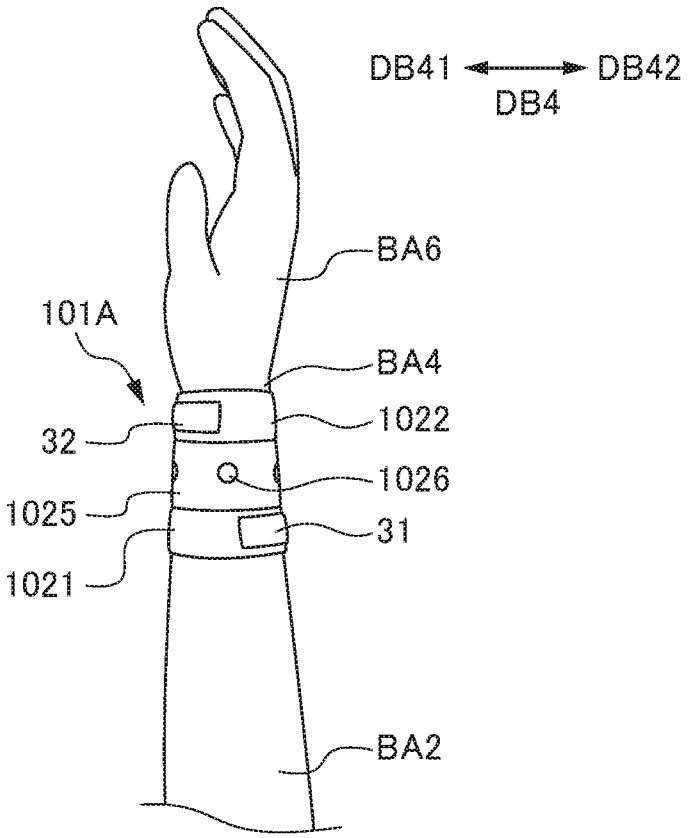
FIG. 19B is a diagram illustrating a state in which the first modification 101A of the second embodiment is worn on the forearm BA2 over the wrist BA4.
Figure 19C:
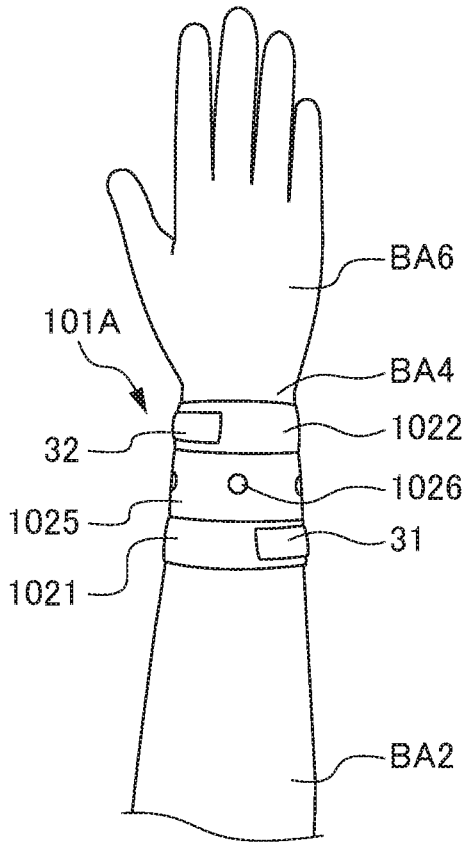
FIG. 19C is a diagram illustrating a state in which the first modification 101A of the second embodiment is worn on the forearm BA2 over the wrist BA4.
Figure 20A:
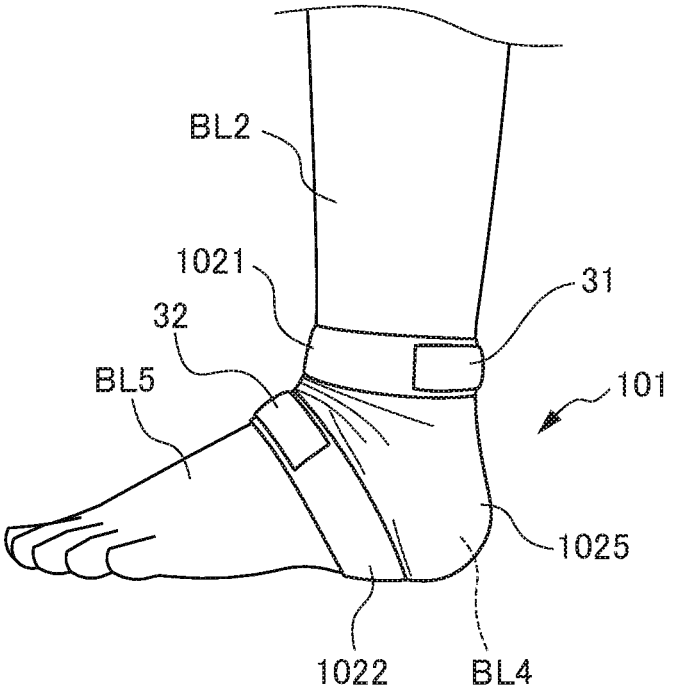
FIG. 20A is a diagram illustrating a state in which the limb training machine 101 according to the second embodiment is worn on the leg BL over the ankle BL4.
Figure 20B:
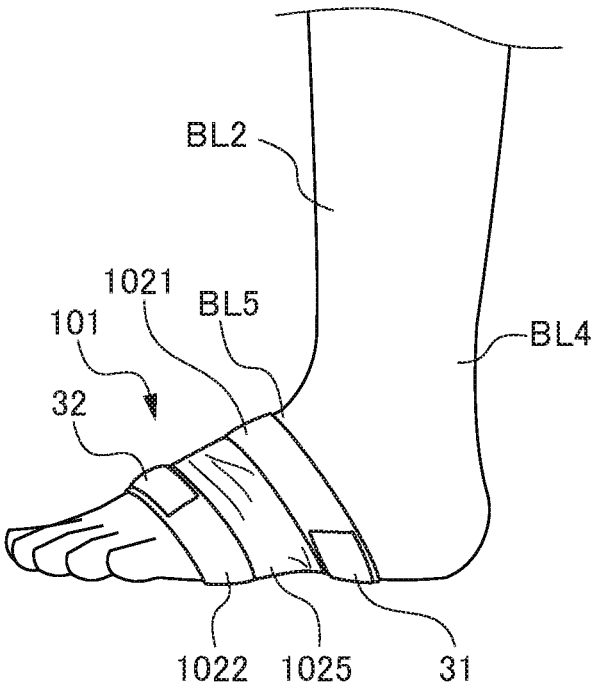
FIG. 20B is a diagram illustrating a state in which the limb training machine 101 according to the second embodiment is worn on a foot BL5.

FIG. 18A is a diagram illustrating a state in which the limb training machine 101 according to the second embodiment is worn on the arm BA over the elbow BA3. FIG. 18B is a diagram illustrating a state in which the first modification 101A of the second embodiment is worn around the wrist BA4. FIGS. 19A to 19C are diagrams illustrating a state in which the first modification 101A of the second embodiment is worn on the forearm BA2 over the wrist BA4. FIG. 20A is a diagram illustrating a state in which the limb training machine 101 according to the second embodiment is worn on the leg BL over the ankle BL4. FIG. 20B is a diagram illustrating a state in which the limb training machine 101 according to the second embodiment is worn on the foot BL5.

In the limb training machine 101 according to the second embodiment, the wearable main body unit 2 is divided into a first weight placement region 1021 in which the first weight 31 is arranged, a second weight placement region 1022 in which the second weight 32 is arranged, and an intermediate region 1025 between the first and second weight placement regions 1021 and 1022 in the axial direction DB1 along the central axis JB1. The first and second weight placement regions 1021 and 1022 do not substantially have an elastic property. The phrase "do not substantially have the elastic property" means that the elastic property is not actively provided in a functional sense, and does not exclude an elastic property inevitably exerted in a material or structural sense. The intermediate region 1025 has an elastic property.

The first weight placement region 1021 has a first pouch portion 21. The second weight placement region 1022 has a second pouch portion 22. The first weight 31 is housed in the first pouch portion 21. The second weight 32 is housed in the second pouch portion 22.

The first and second weight placement regions 1021 and 1022 and the intermediate region 1025 are connectable or separable. Each of the first and second weight placement regions 1021 and 1022 and the intermediate region 1025 includes a first weight placement region forming member, a second weight placement region forming member, and an intermediate region forming member having a zonal shape. In the following description, the word "region" includes a meaning of a "region forming member". The first weight placement region 1021 and the intermediate region 1025 have fasteners 141 and 142, respectively, engaged with each other. The second weight placement region 1022 and the intermediate region 1025 have fasteners 143 and 144, respectively, engaged with each other.

Specifically, an edge region 1021A of the intermediate region 1025 side of the first weight placement region 1021 is provided with a first hook-and-loop fastener 141. An edge region 1022A of the intermediate region 1025 side of the second weight placement region 1022 is provided with a fourth hook-and-loop fastener 144. An edge region 1025A of the first weight placement region 1021 side and an edge region 1025B of the second weight placement region 1022 side of the intermediate region 1025 are provided with a second hook-and-loop fastener 142 and a third fastener 143, respectively.

The first and second pouch portions 21 and 22 are arranged at a predetermined interval in the longitudinal direction DT2 of the first and second weight placement regions 1021 and 1022. The first and second pouch portions 21 and 22 are offset in the width direction DT1 of the first and second weight placement regions 1021 and 1022 (without being overlapped). Specifically, assuming that the wearable main body unit 2 is bisected in the width direction DT1, the first pouch portion 21 is arranged in one of the bisected regions, and the second pouch portion 22 is arranged in the other bisected region. The first and second weights 31 and 32 are arranged substantially in a point symmetric positional relationship.

The first and fourth hook-and-loop fasteners 141 and 144 are, for example, male hook-and-loop fasteners. The second hook-and-loop fastener 42 and the third fastener 143 are, for example, female hook-and-loop fasteners engageable with the male hook-and-loop fasteners. Alternatively, the intermediate region 1025 itself may be used as the female hook-and-loop fastener without providing the second hook-and-loop fastener 42 and the third fastener 143 separately from the intermediate region 1025.

As illustrated in FIGS. 15 and 16, it is possible to form the wearable main body unit 2 by engaging the first and second hook-and-loop fasteners 141 and 142 with each other and engaging the third and fourth hook-and-loop fasteners 143 and 144 with each other. The first and second weights 31 and 32 are curved in the circumferential direction DT4. The first and second weights 31 and 32 may have a rectangular planar shape in an unfolded state and may be curved in a wearing state. Alternatively, the first and second weights 31 and 32 may be curved in advance in an unfolded state.

The wearable main body unit 2 (first and second weight placement regions 1021 and 1022 and the intermediate region 1025) may be formed in advance in a ring shape in the circumferential direction DT4. Alternatively, the wearable main body unit 2 may be connectable using a hook-and-loop fastener or the like.

While the first and second weight placement regions 1021 and 1022 and the intermediate region 1025 are integrated (connected) in both the width direction DT1 and the circumferential direction DT4 to form the wearable main body unit 2, both sides (first and second weight placement regions 1021 and 1022) do not substantially have an elastic property in the axial direction DB1, and the intermediate region 1025 has the elastic property.

Next, a first modification 101A of the second embodiment which is the modification of the second embodiment will be described. According to the first modification 101A of the second embodiment, the intermediate region 1025 has a through-opening 1026 for inserting a thumb BF1 as illustrated in FIGS. 17 and 18B. The through-opening 1026 is a through-hole (like a hole having a closed surrounding). Alternatively, the through-opening 1026 may be a C-shaped opening partially opened. A plurality of through-openings 1026 are provided in the intermediate region 1025 to change a position for inserting the thumb BF1 depending on the wearing direction of the limb training machine toward the limb in the first modification 101A of the second embodiment. According to this modification, four through-openings 1026 are provided at equal intervals (at every 90° along the circumferential direction DT4).

A wearing state in which the limb training machine 101 or 101A according to the second embodiment is worn on the limb B (such as the arm BA or the leg BL) will be described. As illustrated in FIG. 18A, the limb training machine 101 according to the second embodiment may be worn on the arm BA over the elbow BA3. In this case, the first and second weight placement regions 1021 and 1022 that do not substantially have an elastic property are arranged in the upper arm BA1 and the forearm BA2, and the intermediate region 1025 having an elastic property is arranged in the elbow BA3. As illustrated in FIG. 18B, the first modification 101A of the second embodiment is worn on the forearm BA2 around the wrist BA4 while the thumb BF1 is inserted into the through-opening 1026.

As illustrated in FIGS. 19A to 19C, the wearing direction of the limb training machine 101 may be changed along the circumferential direction DT4. For example, as illustrated in FIG. 19A, the first weight 31 of the root BA5 side of the arm BA may be arranged in the right-left inward direction DB32, and the second weight 32 of the wrist BA4 side of the arm BA may be arranged in the right-left outward direction DB31. As illustrated in FIG. 19B, the first weight 31 of the root BA5 side of the arm BA may be arranged in the right-left outward direction DB31, and the second weight 32 of the wrist BA4 side of the arm BA may be arranged in the right-left inward direction DB32. As illustrated in FIG. 19C, the first weight 31 of the root BA5 side of the arm BA may be arranged in the rear direction DB42 of the front-rear direction DB4, and the second weight 32 of the wrist BA4 side of the arm BA may be arranged in the front direction DB41.

As illustrated in FIG. 20A, the limb training machine 101 according to the second embodiment may be worn on the leg BL over the ankle BL4. In this case, the first and second weight placement regions 1021 and 1022 that do not substantially have an elastic property are arranged in the calf BL2 or the foot BL5, and the intermediate region 1025 having an elastic property is arranged in the ankle BL4. The first weight 31 of the thigh BL1 side of the leg BL may be arranged in the rear side, and the second weight 32 of the foot BL5 side of the leg BL may be arranged in the front side. Alternatively, the first and second weights 31 and 32 may have different wearing directions.

As illustrated in FIG. 20B, the limb training machine 101 according to the second embodiment may be worn on the foot BL5. In this case, the first weight 31 of the ankle BL4 side may be arranged in the rear side (lower side), and the second weight 32 of the toe side may be arranged in the front side (upper side). Alternatively, the first and second weights 31 and 32 may have different wearing directions.

Using the limb training machine 101 according to the second embodiment, for example, it is possible to achieve the following effects in addition to the effects of the first embodiment. A wearable main body unit 102 is divided into the first weight placement region 1021 in which the first weight 31 is arranged, the second weight placement region 1022 in which the second weight 32 is arranged, and the intermediate region 1025 between the first and second weight placement regions 1021 and 1022 in the axial direction DB1, and the intermediate region 1025 has an elastic property. Since the elbow BA3 or the wrist BA4 of the arm BA, the knee BL3 or the ankle BL4 of the leg BL, and the like are joints, they are easily expandable or contractible. In this regard, if the limb training machine 101 is worn by placing the intermediate region 1025 having an elastic property in the joint, the limb training machine 101 also expands or contracts depending on expansion or contraction of the joint. For this reason, the limb training machine 101 has high fitting accuracy for the limb including the joint.

As illustrated in FIG. 18B, the intermediate region 1025 according to the first modification 101A of the second embodiment has the through-opening 1026 for inserting the thumb BF1. For this reason, according to the first modification 101A of the second embodiment, it is possible to allow the limb training machine 101 to be easily worn on the forearm BA2 around the wrist BA4 by inserting the thumb BF1 into the through-opening 1026.

The first and second weight placement regions 1021 and 1022 and the intermediate region 1025 are connectable or separable. For this reason, for example, the intermediate region 1025 is easily formed of a material having an elastic property, and the first and second weight placement regions 1021 and 1022 are easily formed of a material substantially not having an elastic property.

The first weight placement region 1021 and the intermediate region 1025 have fasteners 141 and 142, respectively, engaged with each other, and the second weight placement region 1022 and the intermediate region 1025 have fasteners 143 and 144, respectively, engaged with each other. For this reason, it is possible to easily implement a "configuration connectable or separable between the first and second weight placement regions 1021 and 1022 and the intermediate region 1025".

Figure 21:
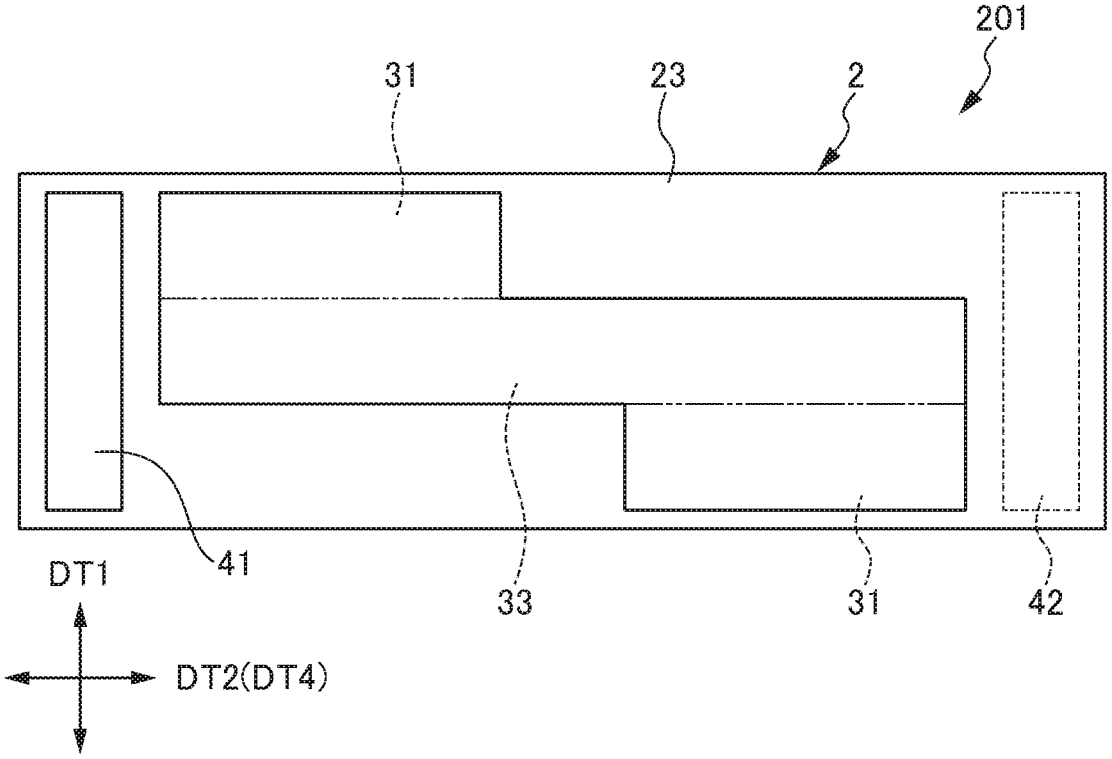
FIG. 21 is a front view illustrating a limb training machine 201 according to a third embodiment of the invention in an unfolded state.

Next, a third embodiment of the present invention will be described. FIG. 21 is a front view illustrating a limb training machine 201 according to a third embodiment of the invention in an unfolded state. In the first and second embodiments, the first and second weights 31 and 32 are separate members. In comparison, according to the third embodiment, the first and second weights 31 and 32 are integrated with each other as illustrated in FIG. 21.

In the limb training machine 201 according to the third embodiment, the first and second weights 31 and 32 are connected and integrated into each other by interposing a third weight 33. In FIG. 21, a boundary between the first and third weights 31 and 33 and a boundary between the second and third weights 32 and 33 are indicated by two-dotted chain lines. The third weight 33 has a belt shape extending across nearly the entire area of the circumferential direction DT4 (except for the surroundings of the hook-and-loop fasteners 41 and 42).

In the limb training machine 201 according to the third embodiment, the first and second weights 31 and 32 are integrated with each other. Specifically, the limb training machine 201 according to the third embodiment has a third weight 33 that has a belt shape extending across nearly the entire area of the circumferential direction DT4 and is integrated with the first and second weights 31 and 32. For this reason, according to the third embodiment, stiffness (resilience) can be provided along the circumferential direction DT4. Note that the integration between the first and second weights 31 and 32 is not limited to the configuration of FIG. 21.

The "substantially in a point symmetric positional relationship" is not limited to a point symmetric positional relationship which is geometrically strict, but may include a non-strict point symmetric positional relationship as long as it can provide the effects of the present invention.

The position of the limb where the limb training machine according to the present invention is worn is not limited. The configuration for installing the first and second weights 31 and 32 in the wearable main body unit 2 is not limited to a case where the first and second weights 31 and 32 are housed in the first and second pouch portions 21 and 22, respectively. For example, the first and second weights 31 and 32 may be fixed to the wearable main body unit 2. The first and second weight placement regions 1021 and 1022 and the intermediate region 1025 may be integrated with each other.

The wearable main body unit is not limited to the ring-shaped configuration. For example, a wearable main body unit having a C-shape (having an opened portion) having resilience (stiffness) may be employed, and this wearable main body unit may also be worn on the limb. The fasteners may be fasteners other than the hook-and-loop fasteners.

EXPLANATION OF REFERENCE NUMERALS

1, 101, 201 LIMB TRAINING MACHINE
2, 102 WEARABLE MAIN BODY UNIT
21 FIRST POUCH PORTION
22 SECOND POUCH PORTION
23 ZONAL MAIN BODY
31 FIRST WEIGHT
32 SECOND WEIGHT
33 THIRD WEIGHT
41, 42, 141, 142, 143, 144, 411, 412, 421, 422, 431, 432, 441, 442 HOOK-AND-LOOP FASTENER (FASTENER)
1021 FIRST WEIGHT PLACEMENT REGION
1022 SECOND WEIGHT PLACEMENT REGION
1025 INTERMEDIATE REGION
1026 THROUGH-OPENING
B LIMB
BA ARM
BA1 UPPER ARM
BA2 FOREARM
BA3 ELBOW
BA4 WRIST
BA5 ROOT
BA6 HAND
BF1 THUMB
BL LEG
BL1 THIGH
BL2 CALF
BL3 KNEE
BL4 ANKLE
BL5 FOOT
DB1 AXIAL DIRECTION
DB2 PERPENDICULAR DIRECTION
DB3 RIGHT-LEFT DIRECTION
DB31 RIGHT-LEFT OUTWARD DIRECTION
DB32 RIGHT-LEFT INWARD DIRECTION
DB4 FRONT-REAR DIRECTION
DB41 FRONT DIRECTION
DB42 REAR DIRECTION
DT1 WIDTH DIRECTION
DT2 LONGITUDINAL DIRECTION
DT4 CIRCUMFERENTIAL DIRECTION
DT5 RADIAL DIRECTION
JB1 CENTRAL AXIS
Q1 FIRST QUADRANT
Q2 SECOND QUADRANT
Q3 THIRD QUADRANT
Q4 FOURTH QUADRANT

The invention claimed is:

1. A limb training machine comprising:

a wearable main body unit wearable on a limb; and weights containing only first and second weights installed in the wearable main body unit, a load being applied to the limb by means of gravitational weights of the first and second weights in a wearing state, wherein when seen in a perpendicular direction to a central axis of a longitudinal direction of the limb in the wearing state, the first and second weights are arranged substantially in a point symmetric positional relationship and in a non-axisymmetric positional relationship with respect to the central axis, and the limb training machine is wearable in different wearing directions, and is configured to be worn in one wearing direction of the different wearing directions depending on a shaking direction of the limb such that the point symmetric positional relationship is formed on a plane parallel with a virtual plane formed in the shaking direction of the limb.

2. The limb training machine according to claim 1, wherein the wearable main body unit is divided into a first weight placement region in which the first weight is arranged, a second weight placement region in which the second weight is arranged, and an intermediate region between the first and second weight placement regions in an axial direction along the central axis, and the intermediate region has an elastic property.

3. The limb training machine according to claim 2, wherein the intermediate region has a through-opening for inserting a thumb.

4. The limb training machine according to claim 2, wherein the first and second weight placement regions and the intermediate region are connectable or separable.

5. The limb training machine according to claim 4, wherein the first weight placement region and the intermediate region respectively have fasteners engaged with each other, and the second weight placement region and the intermediate region respectively have fasteners engaged with each other.

6. The limb training machine according to claim 2, wherein the first weight placement region has a first pouch portion, the second weight placement region has a second pouch portion, the first weight is housed in the first pouch portion, and the second weight is housed in the second pouch portion.

7. The limb training machine according to claim 1, wherein the wearable main body unit has a belt-shaped zonal main body and first and second pouch portions arranged on one side surface of the zonal main body, the first weight is housed in the first pouch portion, and the second weight is housed in the second pouch portion.

8. The limb training machine according to claim 7, wherein the wearable main body unit has fasteners engaged with each other near both longitudinal ends of the zonal main body.

9. The limb training machine according to claim 1, wherein, assuming that the limb training machine is sectioned into four quadrants as seen in the perpendicular direction in the wearing state, the first weight is only included in one quadrant of the four quadrants, and the second weight is only included in another quadrant of the four quadrants.

10. The limb training machine according to claim 1, wherein the first and second weights are integrated with each other.

* * * * *